United States Patent [19]

Fujiwhara et al.

[11] Patent Number: 5,051,346

[45] Date of Patent: Sep. 24, 1991

[54] LIGHT-SENSITIVE PHOTOGRAPHIC MATERIAL COMPRISING LIPOPHILIC COUPLER HYDROPHILIC COUPLER AND DIFFUSION INHIBITOR RELEASING

[75] Inventors: Mitsuto Fujiwhara; Takashi Uchida, both of Hino, Japan

[73] Assignee: Konishiroku Photo Industry Co., Ltd., Tokyo, Japan

[21] Appl. No.: 579,279

[22] Filed: Aug. 31, 1990

Related U.S. Application Data

[63] Continuation of Ser. No. 253,875, Oct. 5, 1988, abandoned, which is a continuation of Ser. No. 147,617, Jan. 22, 1988, abandoned, which is a continuation of Ser. No. 35,201, Apr. 6, 1987, abandoned, which is a continuation of Ser. No. 830,639, Feb. 18, 1986, abandoned.

[30] Foreign Application Priority Data

Feb. 16, 1985 [JP] Japan ..... 60-29673

[51] Int. Cl.[5] ..... G03C 7/32; G03C 7/36

[52] U.S. Cl. ..... 430/544; 430/546; 430/549

[58] Field of Search ..... 430/544, 546, 549

[56] References Cited

U.S. PATENT DOCUMENTS

| | | | |
|---|---|---|---|
| 3,515,557 | 6/1970 | Chu et al. | 430/546 |
| 4,217,410 | 8/1980 | Nakamura et al. | 430/546 |
| 4,297,438 | 10/1981 | Maseler et al. | 430/388 |
| 4,458,012 | 7/1984 | Ito et al. | 430/549 |
| 4,537,857 | 8/1985 | Takada et al. | 430/549 |
| 4,567,135 | 11/1986 | Arakawa et al. | 430/549 |

FOREIGN PATENT DOCUMENTS

| | | | |
|---|---|---|---|
| 0107112 | 5/1984 | European Pat. Off. . | |
| 0114674 | 8/1984 | European Pat. Off. . | |
| 0095948 | 7/1980 | Japan | 430/957 |
| 2005678 | 4/1979 | United Kingdom . | |

OTHER PUBLICATIONS

C. R. Barr et al., "Development-Inhibitor-Releasing DIR Couplers in Color Photography", Photographic Science & Eng., vol. 13, No. 2, Mar.-Apr., 1969.

*Primary Examiner*—Richard L. Schilling

*Attorney, Agent, or Firm*—Frishauf, Holtz, Goodman & Woodward

[57] ABSTRACT

There is disclosed a light-sensitive photographic material which comprises a silver halide emulsion layer containing a first coupler dispersed in oil droplets, a second coupler dispersed in an alkali aqueous solution and a compound capable of releasing a diffusible development inhibiting substance or a precursor thereof.

The specified combination of the first and the second couplers with the diffusible DIR coupler according to the present invention provide a good inter image effect whereby color images having excellent color balance are obtained. The first coupler is preferably selected from compounds of the formula (II), (III), (IV), (V), (VI), (VII) (VIII) which contain at least one lipophilic substituent; and the second coupler is preferably selected from compounds of the formula (IV), (V), (VI), (VII), or (VIII) which do not contain a lipophilic substituent:

(II)

(III)

(IV)

(V)

(VI)

(VII)

(VIII)

19 Claims, No Drawings

LIGHT-SENSITIVE PHOTOGRAPHIC MATERIAL COMPRISING LIPOPHILIC COUPLER HYDROPHILIC COUPLER AND DIFFUSION INHIBITOR RELEASING

This application is a continuation of application Ser. No. 07/253,875, filed Oct. 1, 1988 (abandoned) which is a continuation of Ser. No. 07/147,617 filed Jan. 22, 1988 (abandoned), which is a continuation of Ser. No. 07/035,201 filed Apr. 6, 1987 (abandoned), which is a continuation of Ser. No. 06/830,639 filed Feb. 18, 1986 (abandoned).

BACKGROUND OF THE INVENTION

This invention relates to a light-sensitive photographic material, particularly to a light-sensitive silver halide color photographic material.

In recent years, it has been particularly desired for enhancement of image quality to improve sensitivity, graininess, sharpness and color reproducibility of a light-sensitive silver halide color photographic material (hereinafter sometimes written as color light-sensitive material).

However, if the sizes of silver halide grains are made greater for making sensitivity higher, graininess will be worsened. Besides, if the amounts of coupler and silver halide are increased for elevation of sensitivity, the film thickness of the emulsion layer will consequently be increased, whereby sharpness is lowered.

Accordingly, it is generally difficult to satisfy both the demand for making sensitivity higher and the demand for graininess and sharpness, and the prior art techniques have failed to improve fully the image quality by way of changing the manner in which the basic constituent materials of color light-sensitive material such as coupler and silver halide are used.

On the other hand, as a means for improving graininess and sharpness, it has been known to use a diffusible DI releasing coupler capable of releasing a diffusible development inhibitor (hereinafter called diffusible DIR coupler) as disclosed in, for example, Japanese Provisional Patent Publication No. 131934/1984, etc. However, as can be seen from the prior art, only use of a diffusible DIR coupler in combination with the so called protect type coupler dispersed as oil droplets involves the following problem, although sharpness may be improved to some extent. That is, since the development inhibiting substance diffused from the layer containing a diffusible DIR coupler into other layers with different color sensitivities inhibits excessively development in other layers, disadvantages in aspect of color reproduction become increased such as marked loss of color balance of the image particularly when the other layers are adjacent low density layers. This is because of excessive occurrence of development called as inter image effect, and it has been desired to suppress such an inter image effect.

SUMMARY OF THE INVENTION

An object of the present invention is to provide a light-sensitive photographic material which is high in sensitivity and can improve markedly graininess and color reproducibility, while improving also sharpness.

More specifically, the present invention concerns a light-sensitive photographic material comprising a silver halide emulsion layer containing a first coupler dispersed as oil droplets, a second coupler dispersed as an aqueous alkali solution and a compound capable of releasing a diffusible development inhibiting substance or a precursor thereof.

DESCRIPTION OF THE PREFERRED EMBODIMENTS

According to the present invention, it has been found that the object of the present invention can be fully realized by combination of the first and the second couplers as mentioned above which are to be dispersed according to different methods. In this case, the first coupler dispersed as oil droplets has lipophilic groups and soluble in a high boiling point organic solvent (an alkali soluble group is not essential). On the other hand, the second coupler dispersed as an aqueous alkali solution has at least one acidic group such as sulfonic acid group or carboxylic group, the coupler itself and the color forming dye being preferably those which will not be diffused through a hydrophilic colloid (in this case, as a group which prevents diffusion, at least one organic group with 8 or more carbon atoms is permitted to exist at the non-active point, namely the site where it will not be eliminated through the coupling reaction). And, in the emulsion layer containing the first coupler and the second coupler, the second coupler exists in a state dispersed as the alkali soluble type, whereby it may be considered that the developing initial reaction is rapid to improve markedly graininess. The second coupler should desirably be contained in an amount of 50 mole % or less based on the total amount of the couplers, because not only graininess but also sharpness can be excellently maintained thereby.

The proportion of the second coupler may further preferably be 30 mole % or less, particularly 10 mole % or less based on the total amount of the first and second couplers. The first coupler may be added to a conventional high boiling point organic solvent droplet type, and an alkali solution of the second coupler can be added before or after preparation of the droplet.

The present inventors have further investigated about the combined use of the first coupler and the second coupler which can bring about the marked effect as mentioned above. As a consequence, it has been found that sharpness is still insufficient, although graininess can be fully improved by combined use of the both couplers. However, it has been found that sharpness can be also fully improved simultaneously with prevention of loss of color balance through the excessive overlaying effect as already described by addition of a diffusible DIR coupler (or diffusible DIR compound) to the combined coupler system. Such prevention of excessive overlaying effect may be considered to be due to reduced release of diffusible DI through the reaction of a diffusible DIR compound and the oxidized product of a developing agent on account of rapid reaction of the second coupler of the aqueous alkali solution dispersed type of the above both couplers with the oxidized product of a developing agent during development.

The light-sensitive silver halide photographic material of the present invention can be, for example, negative and positive films of color negative, and also color printing papers, and the light-sensitive materials may be for either monochromatic or multi-color uses. In the case of light-sensitive silver halide photographic materials for multi-color, in order to effect the detractive color reproduction, they have structures in which silver halide emulsion layers containing respective couplers of magenta, yellow and cyan as couplers for photography and non-light-sensitive layers laminated on a support in desired layer number and layer order, and said layer number and layer order may be changed as desired depending on the important performance and the purpose of use.

The magenta coupler to be used in the present invention may include pyrazolotriazole couplers, 5-pyrazolone couplers, pyrazolobenzimidazole couplers, cyanoacetyl coumarone couplers, open-chain acylacetonitrile couplers, etc.; yellow couplers may include acylacetamide couplers (e.g. benzoylacetanilides, pivaloylacetanilides), etc.; and cyan couplers may include naphthol couplers and phenol couplers. The couplers may be either 4-equivalent or 2-equivalent relative to silver ions.

Yellow couplers may preferably be those having benzoylacetanilide as the mother nucleus, particularly the yellow couplers represented by the formula (II):

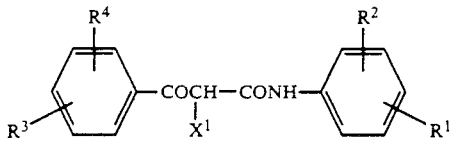

(II)

wherein $R^1$, $R^2$, $R^3$ and $R^4$ are each substituting component (substituent or atom such as hydrogen atom), $X^1$ is a group or an atom eliminable through the reaction of the coupler of the formula (II) and the oxidized product of a color forming developing agent.

In the above formula (II), $R^1$, $R^2$, $R^3$ and $R^4$ may be either identical or different, and may include, for example, a hydrogen atom, a halogen atom, an alkyl group (e.g. a methyl group, an ethyl group, an isopropyl group, etc.), an alkoxy group (e.g. a methoxy group, an ethoxy group, a methoxyethoxy group, etc.), an aryloxy group (e.g. a phenoxy group, etc.), an acylamino group (e.g. an acetylamino group, a trifluoroacetylamino group, etc.), a sulfonamino group (e.g. a methanesulfonamino group, a benzenesulfonamino group, etc.), a carbamoyl group, a sulfamoyl group, an alkylthio group, an alkylsulfonyl group, an alkoxycarbonyl group, a ureido group, a carboxyl group, a hydroxyl group, a sulfo group, a cyano group, etc. As the first coupler, there may be employed one in which at least one of $R^1$ to $R^4$ has a lipophilic group (e.g. a 2,4-di-t-amylphenoxyalkyl group, a heptadecyl group, etc.), while as the second coupler, there may be employed one in which at least one of $R^1$ to $R^4$ has a diffusion preventive group (e.g. a group with 8 or more carbon atoms such as a dodecyl group, etc.) and at least one of $R^1$ to $R^4$ and Xl contains an acidic group (e.g. a carboxyl group, a sulfo group). Xl may be exemplified by a hydrogen atom, a halogen atom and those represented by the following formulae:

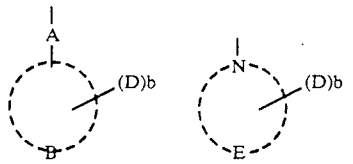

In the above formulae, A represents an oxygen atom or a sulfur atom, B represents a group of non-metal atoms necessary for forming an aryl ring or a hetero ring and E represents a group of non-metal atoms necessary for formation of a 5- or 6-membered hetero ring. These rings may be further fused with an aryl ring or a hetero ring. D represents an organic group (e.g an alkyl group, an aryl group) or an atom (e.g. a halogen atom), and b represents 0 or a positive integer. When b is a plural, D may be either identical or different. D may also contain a linking group such as —O—, —S—, —COO—, —CONH—, —$SO_2$NH—, —NHCONH—, —$SO_2$—, —CO—, —NHCO—, —OCO—, —NH-$SO_2$—, —NH—, etc.

Also, yellow couplers having pivaloylacetanilide as the mother nucleus are preferred. Particularly, the yellow couplers having the following formula (III) may be available.

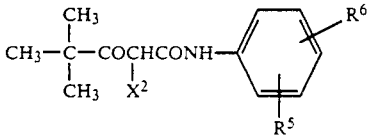

(III)

$R^5$ and $R^6$ have the same meanings as $R^1$ and $R^2$ as mentioned above, which may be either identical or different, and may include, for example, a hydrogen atom, a halogen atom, an alkyl group (e.g. a methyl group, an ethyl group, an isopropyl group, etc.), an alkoxy group (e.g. a methoxy group, an ethoxy group, a methoxyethoxy group, etc.), an aryloxy group (e.g. a phenoxy group, etc.), an acylamino group (e.g. an acetylamino group, a trifluoroacetylamino group, etc.), a sulfonamino group (e.g. a methansulfonamino group, a benzenesulfonamino group, etc.), a carbamoyl group, a sulfamoyl group, an alkylthio group, an alkylsulfonyl group, an alkoxycarbonyl group, a ureido group, a carboxyl group, a hydroxy group, a sulfo group and a cyano group.

As the first coupler, there may be employed one in which at least one of $R^5$ and $R^6$ has a lipophilic group (e.g. a 2,4-di-t-amylphenoxyalkyl group, a heptadecyl group, etc.), while as the second coupler, there may be employed one in which at least one of $R^5$ and $R^6$ has a diffusion preventive group (e.g. a group with 8 or more carbon atoms such as a dodecyl group, etc.) and at least one of $R^5$, $R^6$ and $X^2$ contains an acidic group (e.g. a carboxyl group, a sulfo group).

$X^2$ has the meaning as $X^1$ as described above and include the same examples.

The preferable low molecular weight magenta couplers to be used in the present invention have pyrazolotriazole as the mother nucleus, particularly magenta couplers represented by the formula (IV):

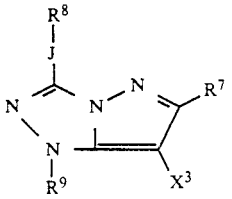

(IV)

wherein $R^7$, -J-$R^8$ and $R^9$ have the same meanings as $R^1$ as described above, and $X^3$ has the same meaning as $X^1$ as described above.

$R^7$ and $R^8$ may be, for example, hydrogen atoms, alkyl groups which may each have a substituent (e.g. a methyl group, an ethyl group, an isopropyl group, a propyl group, a butyl group), an aryl group (e.g. a phenyl group, a naphthyl group) or hetero ring residues; J represents a bonding, for example, —O—, —S—,

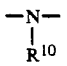

($R^{10}$ represents a hydrogen atom or an alkyl group); and $R^9$ represents, for example, a hydrogen atom. As the the first coupler, there may be employed one in which at least one of $R^7$ to $R^9$ has a lipophilic group (e.g. a 2,4-di-t-amylphenoxyalkyl group, a heptadecyl group, etc.), while as the second coupler, there may be employed one in which at least one of $R^7$ to $R^9$ has a diffusion preventive group (e.g. a group with 8 or more carbon atoms such as a dodecyl group, etc.) and at least one of $R^7$ to $R^9$ and $X^3$ contains an acidic group (e.g. a carboxyl group, a sulfo group) As $X^3$, a hydrogen atom, a halogen atom and groups of the following formulae are preferred.

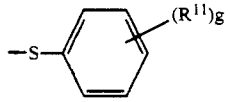

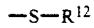

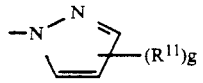

In the above formulae, g represents 0 or a positive integer.

In the above formulae, $R^{11}$ is a group or an atom selected from halogen atoms, alkyl groups (e.g. a methyl group, an ethyl group), alkoxy groups (e.g. a methoxy group, an ethoxy group), acylamino groups (e.g. an acetamido group, a benzamido group), alkoxycarbonyl groups (e.g. a methoxycarbonyl group), anilino groups (e.g. a 2-chloroanilino group, a 5-acetamidoanilino group), N-alkylcarbamoyl groups (e.g. an N-methylcarbamoyl group), ureido groups (e.g. an N-methylureido group), a cyano group, aryl groups (e.g. a phenyl group, a naphthyl group), N,N-dialkylsulfamoyl groups, a nitro group, a hydroxy group, a carboxy group and aryloxy groups, and $R^{11}$ may be either identical or different when g is 2 or more. $R^{12}$ represents a substituted or unsubtituted alkyl group (e.g. a butyl group, a methyl group, etc.), an aralkyl group (e.g. a benzyl group, etc.) an alkenyl group (e.g. n allyl group, etc.) or a cyclic alkyl group (e.g. a cyclopentyl group, etc.), and the substituents may be selected from halogen atoms, alkoxy groups (e.g. a butoxy group, a methyloxy group, etc.), acylamino groups (e.g. an acetamide group, a tetradecanamide group, etc.), alkoxycarbonyl groups (e.g. a methoxycarbamoyl group, etc.), N-alkylcarbamoyl groups (e.g. an N-methylcarbamoyl group, etc.), ureido groups (e.g. an ethylureido group, etc.), a cyano group, aryl groups (e.g. a phenyl group), a nitro group, alkylthio groups (e.g. a methylthio group, etc.), alkylsulfinyl groups (e.g. an ethylsulfinyl group, etc.), sulfonamide groups (e.g. an ethylsulfonamide group, etc.), N-aklylsulfamoyl groups, aryloxy groups and acyl groups (e.g. an acetyl group, etc.).

Other magenta couplers than those as mentioned above may preferably be those having 1-phenyl-5-pyrazolone or pyrazolobenzimidazole as the mother nucleus, particularly those represented by the following formulae (V) and (VI).

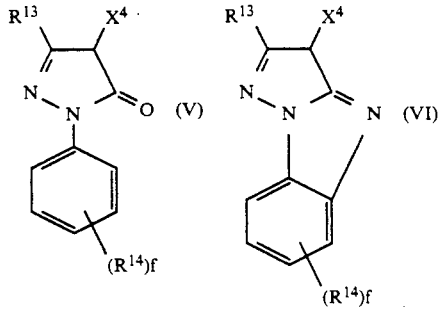

Here, each of $R^{13}$ and $R^{14}$ is the same as $R^1$ as described above, and $X^4$ is the same as $X^1$ as described above.

In the above formulae (V) and (VI), $R^{13}$ may include, for example, an acylamino group (e.g. a propanamide group, a benzamide group), an anilino group (e.g. a 2-chloroanilino group, a 5-acetamidoanilino group) or a ureido group (e.g. a phenylureido group, a butaneureido group); and $R^{14}$ may include, for example, a hydrogen atom, a halogen atom, an alkyl group, an alkoxy group, a hydroxycarbonyl group, an alkoxycarbonyl group, a nitro group, an aryloxy group, a sulfo group, a carboxy group, a cyano group or an acylamino group. As the first coupler, there may be employed one in which at least one of $R^{13}$ and $R^{14}$ has a lipophilic group (e.g. a 2,4-di-t-amylphenoxyalkyl group, a heptadecyl group, etc.), while as the second coupler, there may be employed one in which at least one of $R^{13}$ and $R^{14}$ has a diffusion preventive group (e.g. a group with 8 or more carbon atoms such as a dodecyl group, etc.) and at least one of $R^{13}$, and $X^4$ contains an acidic group (e.g. a carboxyl group, a sulfo group). $X^4$ may include the same examples as mentioned above for $X^3$. f is an integer of 0 to 4, and the respective $R^{14}$ may be either identical or different when f is 2 or more.

The cyan couplers available in the present invention may preferably have phenol or naphthol as the mother nucleus, including particularly those represented by the following formulae (VII) and (VIII):

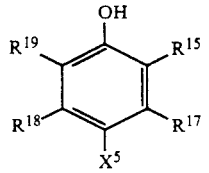

(VII)

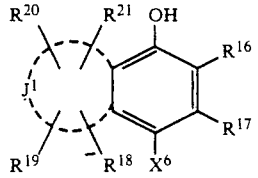

(VIII)

In these formulae, each of $R^{15}$ to $R^{21}$ has the same meaning as $R^1$ as mentioned above, and each of $X^5$ and $X^6$ has the same meaning as $X^1$ as mentioned above.

$R^{15}$ may include, for example, a hydrogen atom, an aliphatic group (e.g. an alkyl group such as methyl, isopropyl, acyl, cyclohexyl, octyl), an alkoxy group (e.g. methoxy, isopropoxy, pentadecyloxy), an aryloxy group (e.g. phenoxy, β-tert-butylphenoxy), acylamide groups, sulfonamide groups, ureido groups or carbamoyl groups represented by the following formulae:

—NH—CO—G

—NH—$SO_2$—G

—NHCONH—G

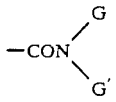

In the above formulae, G and G' may be either identical or different, and each of them represents a hydrogen atom (provided that G and G' cannot be hydrogen atoms at the same time), an aliphatic group having 1 to 8 carbon atoms, preferably a straight or branched alkyl group or a cyclic alkyl group each having 4 to 8 carbon atoms (e.g. cyclopropyl, cyclohexyl, norbornyl, etc.), or an aryl group (e.g. phenyl, naphthyl, etc.). Here, the above alkyl group or aryl group may be substituted with halogen atoms (e.g. fulorine, chlorine, etc.), a nitro group, a cyano group, a carboxyl group, a sulfo group, a hydroxy group, amino groups (e.g. amino, alkylamino, dialkylamino, anilino, N-alkylanilino, etc.), alkyl groups (e.g. those as mentioned above), aryl groups (e.g. phenyl, acetylaminophenyl, etc.), alkoxycarbonyl groups (e.g. butyloxycarbonyl, etc.), an acyloxycarbonyl group, amide groups (e.g. acetamide, methansulfonamide, etc.), imide groups (e.g. succinimide, etc.), carbamoyl groups (e.g. N,N-diethylcarbamoyl, etc.), sulfamoyl groups (e.g. N,N-diethylsulfamoyl, etc.), alkoxy groups (e.g. ethoxy, butyloxy, octyloxy, etc.), aryloxy groups (e.g. phenoxy, methylphenoxy, etc.), etc. $R^{15}$ may include conventionally used substituents other than the above mentioned substituents. $R^{16}$ may be selected from, for example, a hydrogen atom, an aliphatic group, particularly an alkyl group or a carbamoyl group represented by the above formula. Examples of $R^{17}$, $R^{18}$, $R^{19}$, $R^{20}$ and $R^{21}$ may each include a hydrogen atom, a halogen atom, an alkyl group, an aryl group, an alkoxy group, an alkylthio group, a heterocyclic group, an amino group, a carbonamide group, a sulfonamide group, a sulfamyl group or a carbamyl group. Typical examples of $R^{17}$ may include the following:

a hydrogen atom, halogen atoms (e.g. chlorine, bromine, etc.), a primary, secondary or tertiary alkyl group (e.g. methyl, propyl, isopropyl, n-butyl, secbutyl, tert-butyl, hexyl, 2-chlorobutyl, 2-hydroxyethyl, 2-phenylethyl, 2-(2,4,6-trichlorophenyl)ethyl, 2-aminoethyl, etc.), alkylthio groups (e.g. octylthio, etc.), aryl groups (e.g. phenyl, 4-methylphenyl, ,4,6-trichlorophenyl, 3,5-dibromophenyl, 4-trifluoromethylphenyl, 2-tolylfluoromethylphenyl, 3-trifluoromethylphenyl, naphthyl, 2-chloronaphthyl, 3-ethylnaphthyl, etc.), heterocyclic groups (e.g. a benzofuranyl group, a furanyl group, a thiazolyl group, a benzothiazolyl group, a naphthothiazolyl group, an oxazolyl group, a benzoxazolyl group, a naphthoxazolyl group, a pyridiyl group, a quinolynyl group, etc.), amino groups (e.g. amino, methylamino, diethylamino, phenylamino, tolylamino, 4-cyanophenylamino, 2-trifluoromethylphenylamino, benzothiazolamino, etc.), carbonamide groups (e.g. alkylcarbonamide groups such as an ethylcarbonamide group; acrylcarbonamide groups such as phenylcarbonamide, 2,4,6-trichlorophenylcarbonamide, 4-methylphenylcarbonamide, 2-ethoxyphenylcarbonamide, etc.; heterocyclic carbonamides such as thiazolylcarbonamide, benzothiazolylcarbonamide, oxazolylcarbonamide, benzooxazolylcarbonamide, imidazolylcarbonamide, benzimidazolylcarbonamide, etc.), sulfonamide groups (e.g. alkylsulfonamide groups such as butylsulfonamide, phenylethylsulfonamide, etc.), arylsulfonamide groups such as phenylsulfonamide, 2,4,6-trichlorophenylsulfonamide, 2-methoxyphenylsulfonamide, 3-carboxyphenylsulfonamide, etc.; heterocyclic sulfonamide groups such as thiazolylsulfonamide, benzothiazolylsulfonamide, imidazolylsulfonamide, benzimidazolylsulfonamide, pyridylsulfonamide, etc.), sulfamyl groups (e.g. alkylsulfamyl groups such as propylsulfamyl, octylsulfamyl, etc.; arylsulfamyl groups such as phenylsulfamyl, 2,4,6-trichlorophenylsulfamyl, 2-methoxyphenylsulfamyl, etc.; heterocyclic sulfamyl groups such as thiazolylsulfamyl, benzothiazolylsulfamyl, oxazolylsulfamyl, benzimidazolylsulfamyl, pyridylsulfamyl, etc.), and carbamyl groups (e.g. alkyl carbamyl groups such as ethylcarbamyl, octylcarbamyl, etc.; aryl carbamyl groups such as phenylcarbamyl, 2,4,6l -trichlorophenylcarbamyl, etc.; and heterocyclic carbamyl groups such as thiazolylcarbamyl, benzothiazolylcarbamyl, oxazolylcarbamyl, imidazolylcarbamyl, benzimidazolylcarbamyl, etc.).

Examples of $R^{18}$, $R^{19}$, $R^{20}$ and $R^{21}$ may also include those as mentioned above for $R^{17}$, respectively. $J^1$ represents non-metal atoms necessary for formation of a 5- or 6-membered ring as mentioned below. That is, benzene ring, cyclohexene ring, cyclopentene ring, thiazole ring, oxazole ring, imidazole ring, pyridine ring and pyrrole ring may be included. Among them, benzene being is preferred.

In the formula (VII), as the first coupler, there may be employed one in which at least one of $R^{15}$ and $R^{17}$ to $R^{19}$ has a lipophilic group (e.g. a 2,4-di-t-amylphenoxyalkyl group, a heptadecyl group, etc.), while as the second coupler, there may be employed one in which at least one of $R^{15}$ and $R^{17}$ to $R^{19}$ has a diffusion preventive group (e.g. a group with 8 or more carbon atoms such as a dodecyl group, etc.) and at least one of $R^{15}$, $R^{17}$ to $R^{19}$ and $X^5$ contains an acidic group (e.g. a carboxyl group, a sulfo group).

In the formula (VIII), as the first coupler, there may be employed one in which at least one of $R^{16}$ to $R^{21}$ has a lipophilic group (e.g. a2,4-di-t-amylphenoxyalkyl group, a heptadecyl group, etc.), while as the second coupler, there may be employed one in which at least one of $R^{16}$ to $R^{21}$ has a diffusion preventive group (e.g. a group with 8 or more carbon atoms such as a dodecyl group) and at least one of $R^{16}$ to $R^{21}$ and $X^6$ contains an acidic group (e.g. carboxyl, sulfo).

$X^5$ and $X^6$ may preferably be a hydrogen atom, a halogen atom or a group (e.g alkyl, aryl, heterocyclic ring) bonded to the coupling position through —O—, —S— or —N=N—. Preferred examples of said group may include alkoxy, aryloxy, alkylthio and arylthio groups. These groups may further have substituents (e.g. alkyl, aryl, heterocyclic ring) through divalent groups such as —O—, —S—, —NH—, —CONH—, —COO—, —$SO_2$NH—, —SO—, —$SO_2$, —CO—,

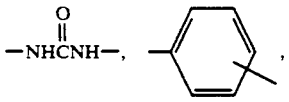
etc. Further, these groups may also have carboxyl groups, sulfo groups, sulfamoyl group, hydroxy groups, etc. as the substituents.
Specific examples of preferred first couplers are shown below.
y-1
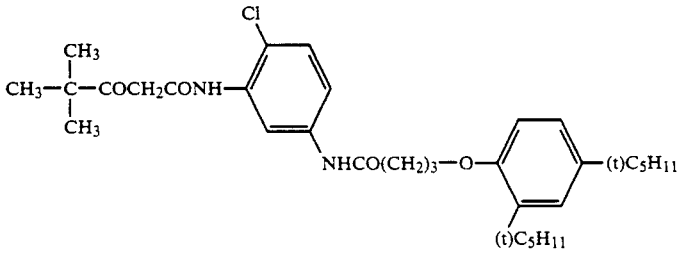
y-2
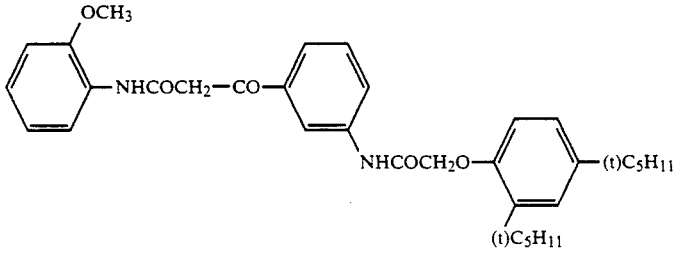
y-3
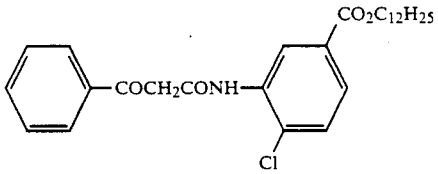
y-4
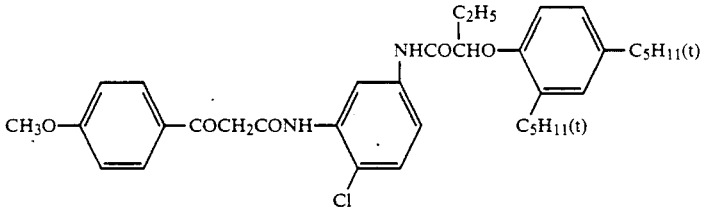
y-5
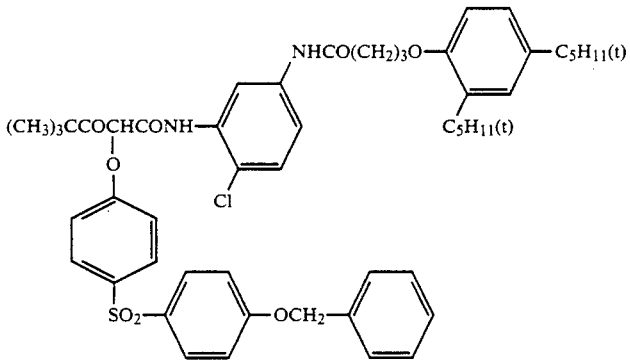
y-6
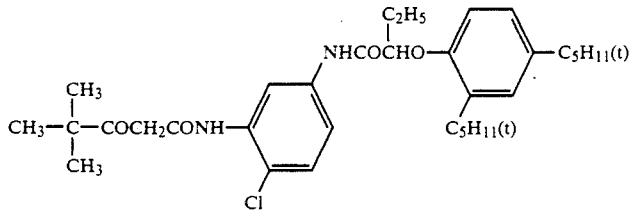

-continued
y-7
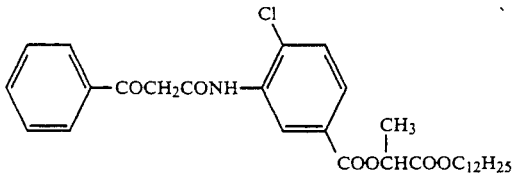
y-8
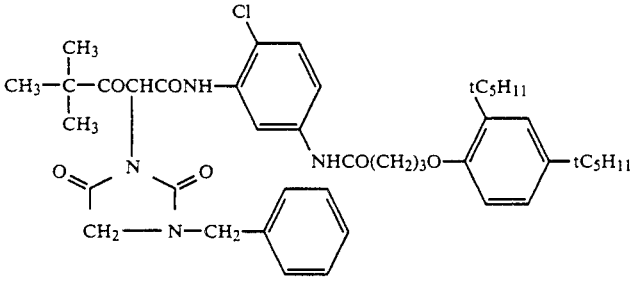
y-9
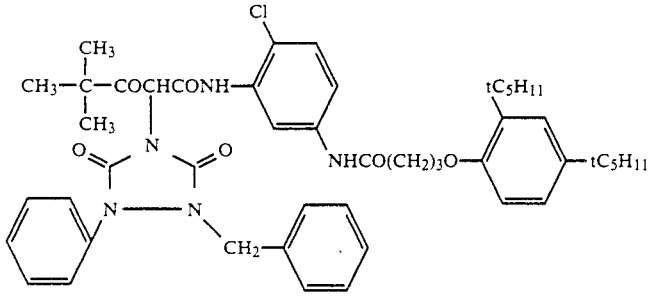
y-10
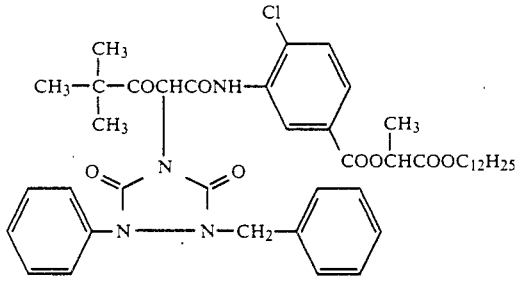
y-11
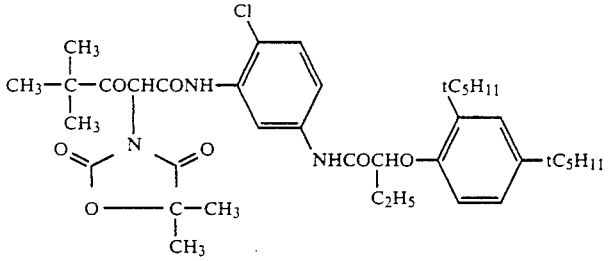
y-12
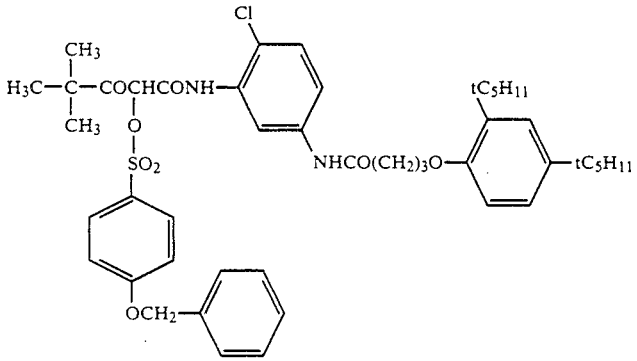

-continued
y-13
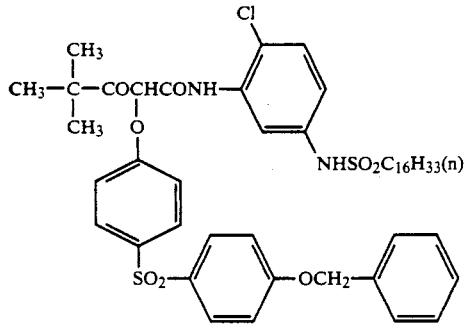
y-14
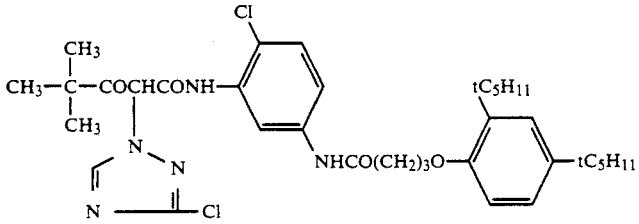
y-15
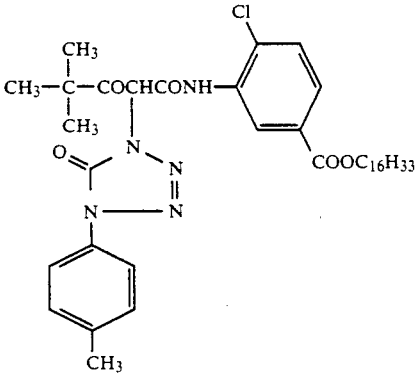
y-16
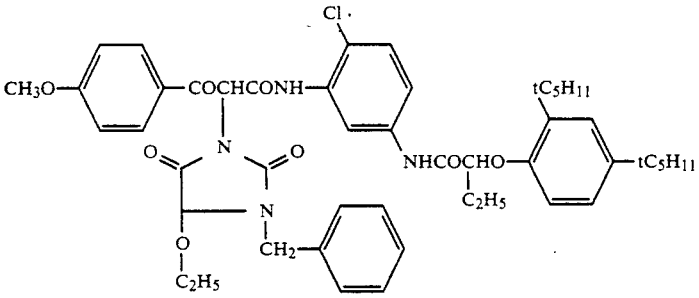
y-17
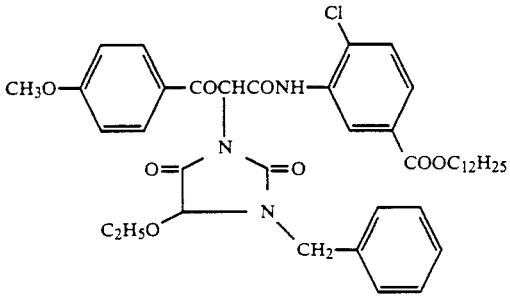

-continued
y-18
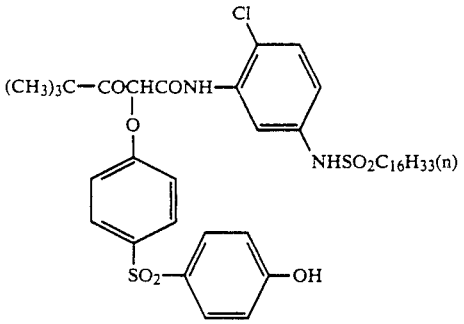
m-1
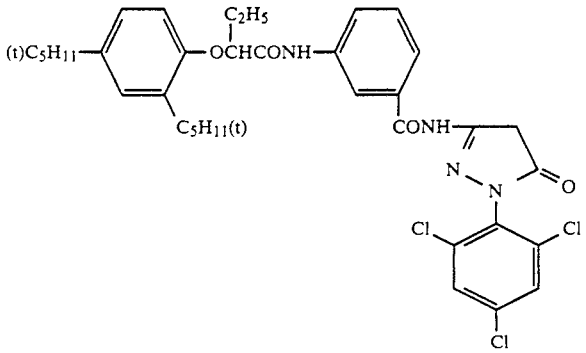
m-2
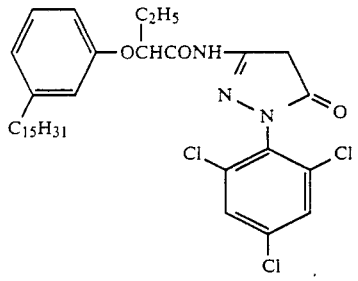
m-3
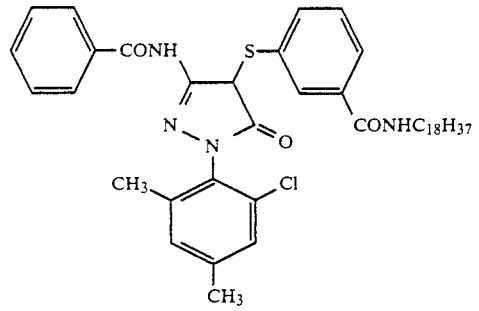
m-4
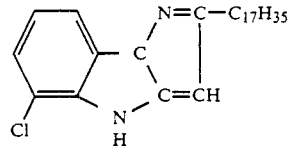

-continued
m-5
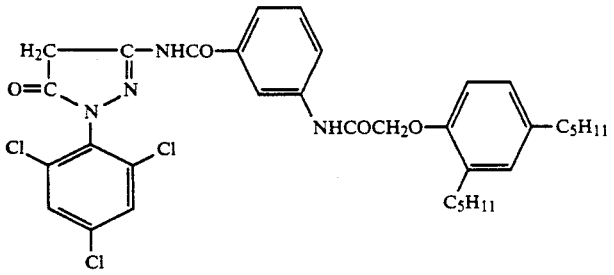
m-6
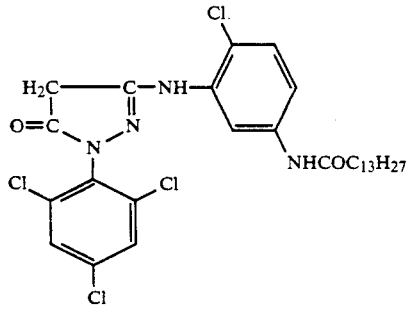
m-7
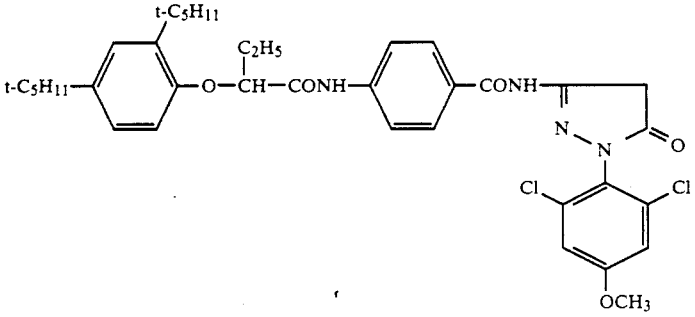
m-8
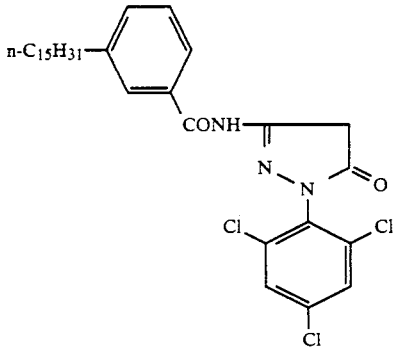
m-9
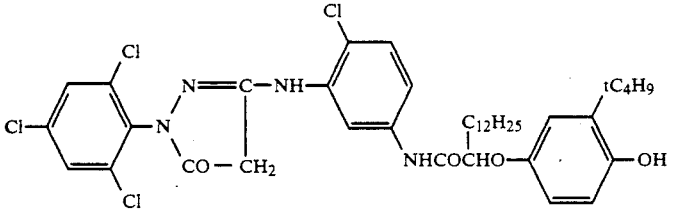
m-10
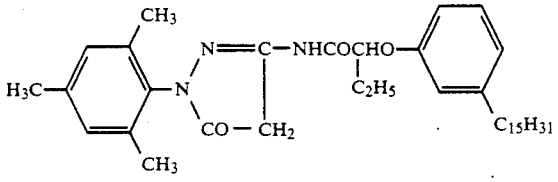

-continued
m-11
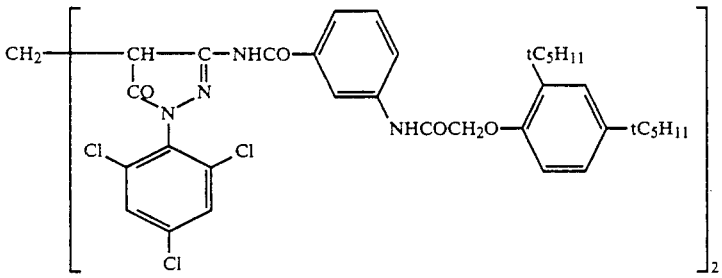
m-12
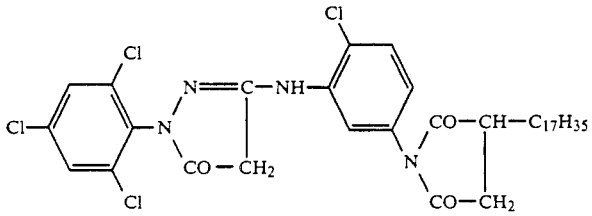
m-13
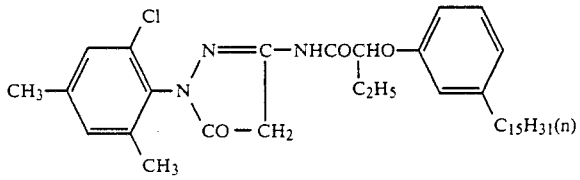
m-14
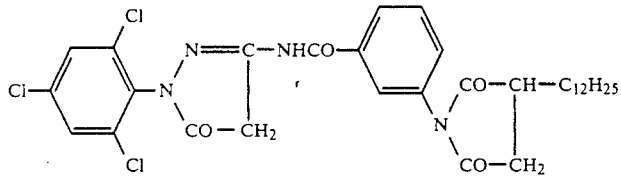
m-15
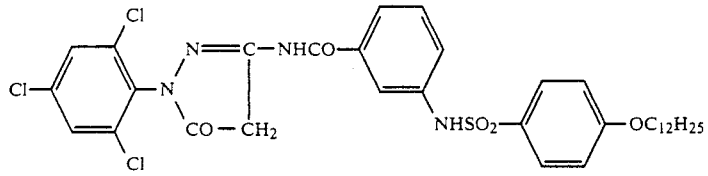
m-16
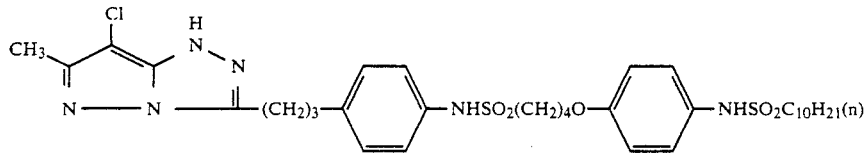
m-17
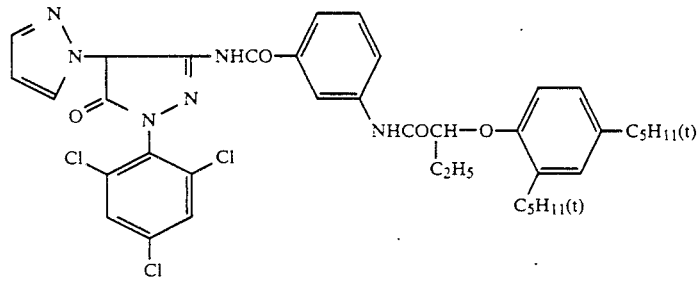

-continued
m-18
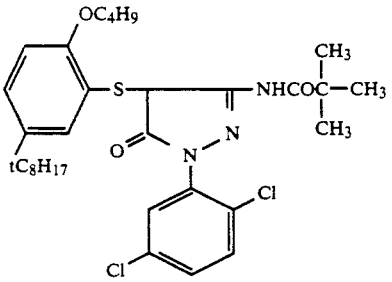
m-19
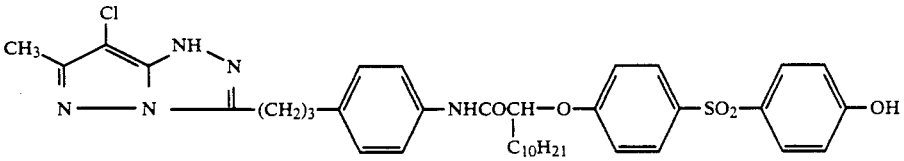
c-1
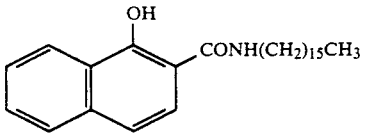
c-2
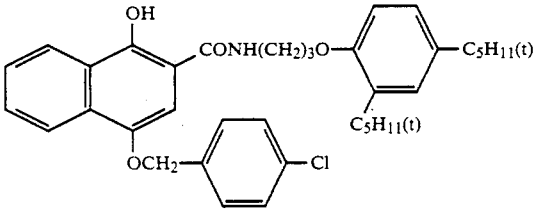
c-3
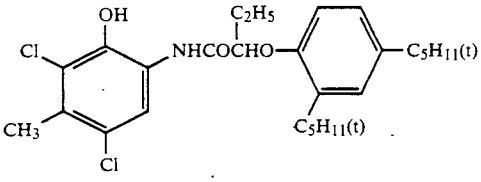
c-4
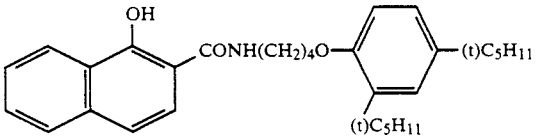
c-5
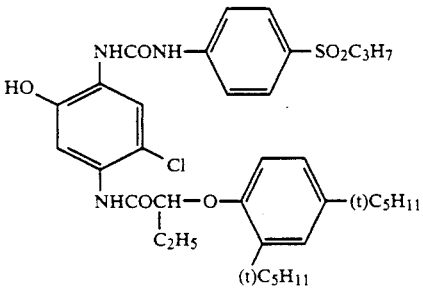
c-6
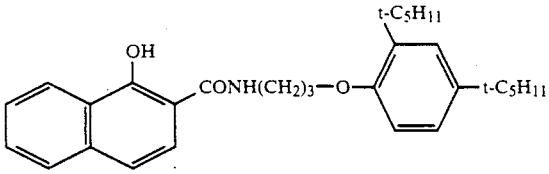

-continued
c-7
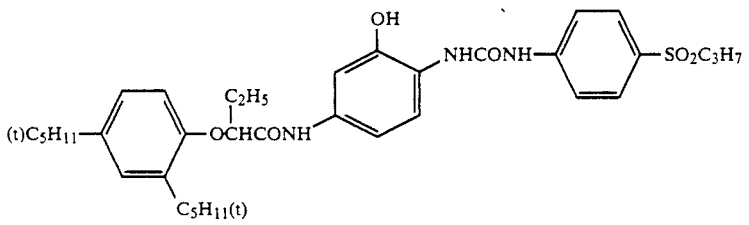
c-8
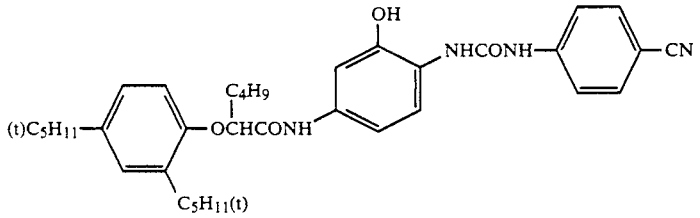
C-9
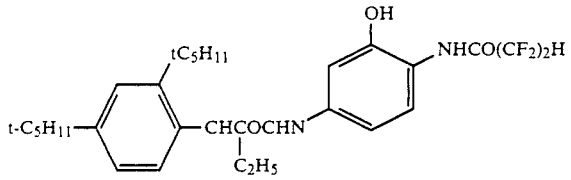
C-10
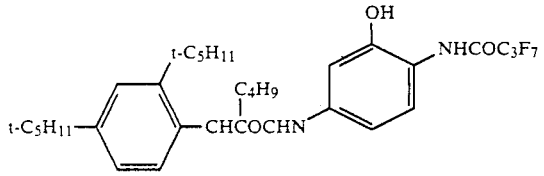
C-11
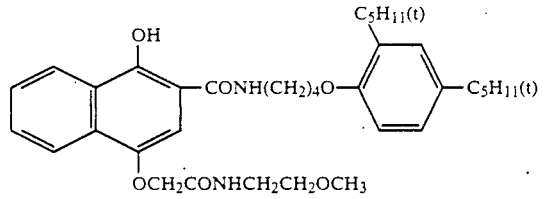
C-12
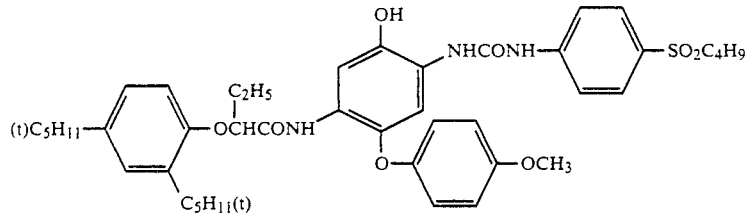
C-13
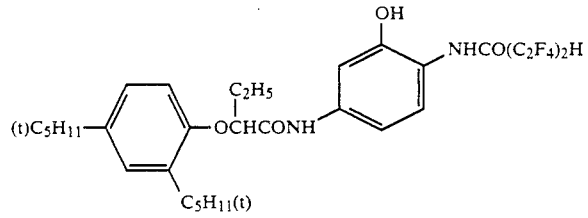
Specific examples of preferred second couplers are shown below.
65

Y-1
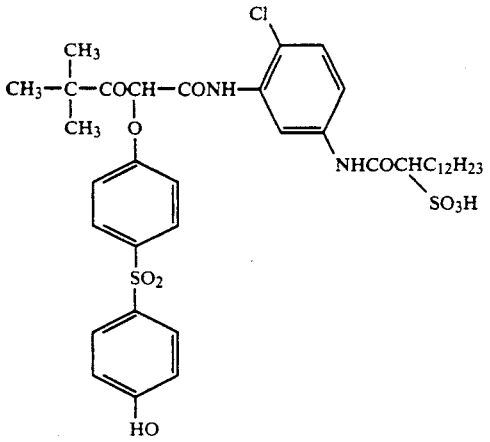
Y-2
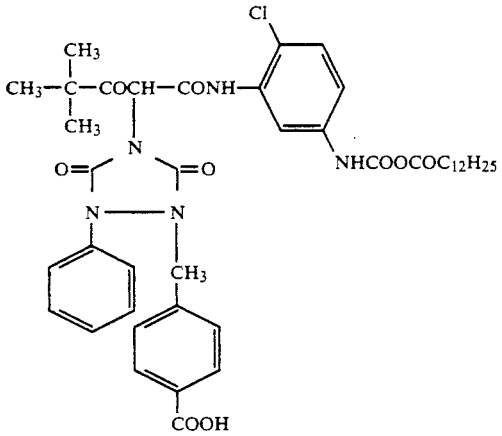
Y-3
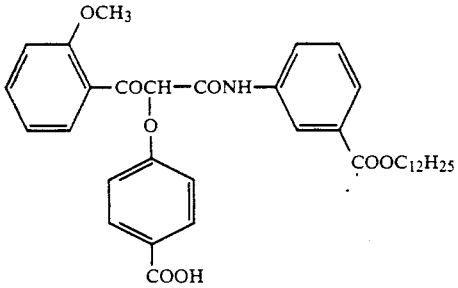
Y-4
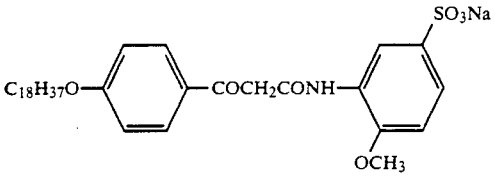
M-1
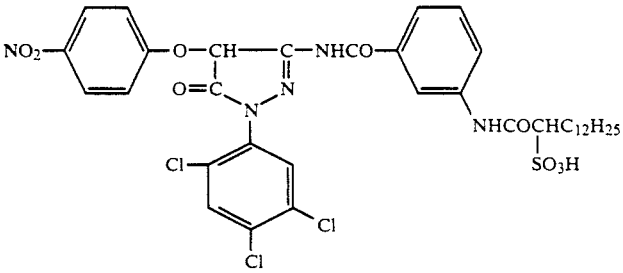

-continued
M-2
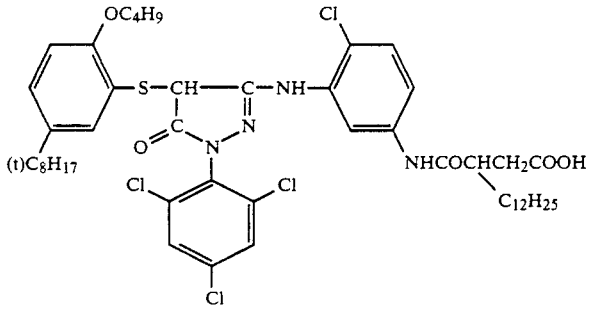
M-3
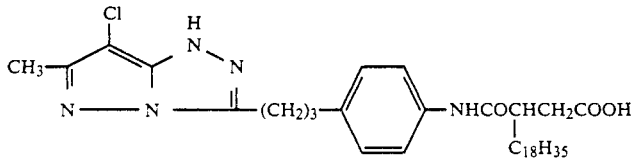
M-4
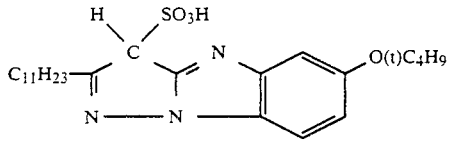
M-5
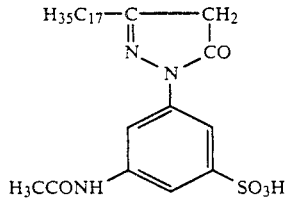
M-6
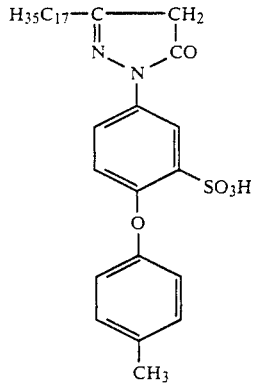
M-7
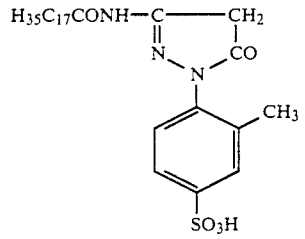

-continued
M-8
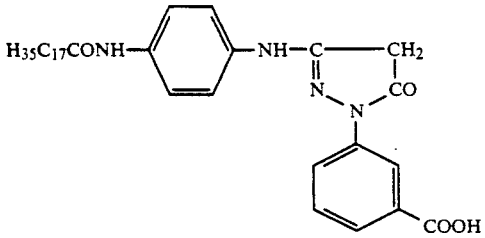
M-9
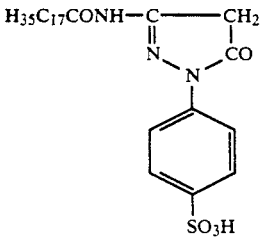
M-10
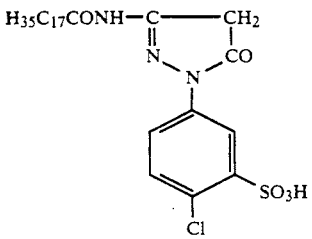
M-11
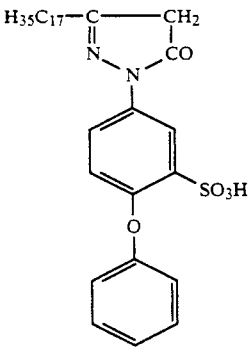
M-12
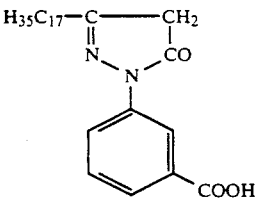
M-13
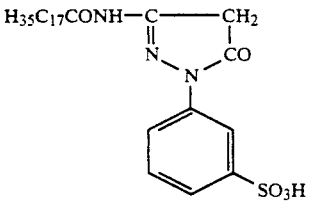

-continued
M-14
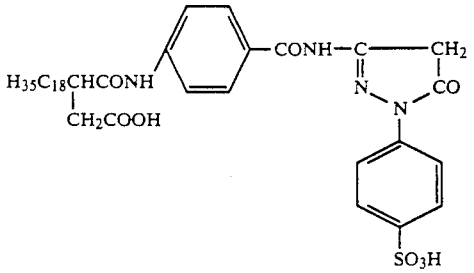
M-15
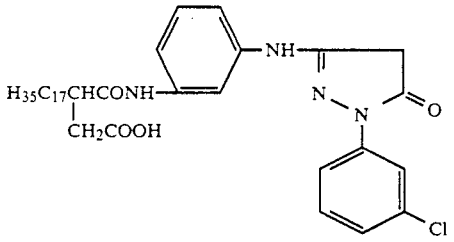
M-16
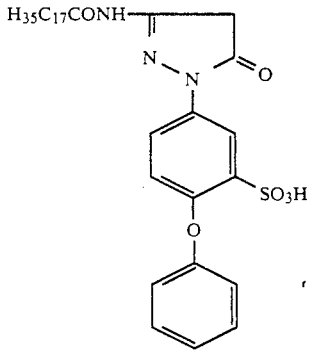
C-1
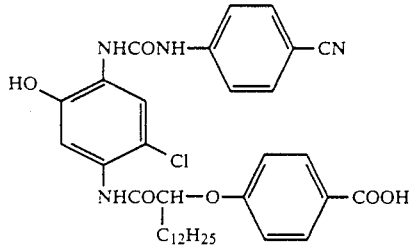
C-2
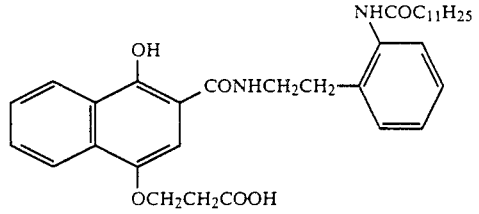
C-3
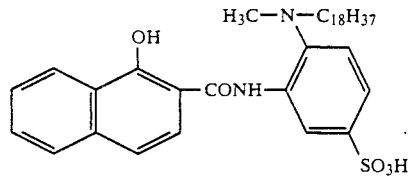

-continued

C-4

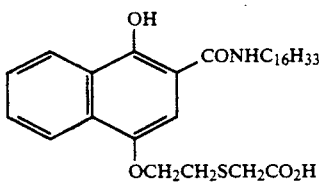

C-5

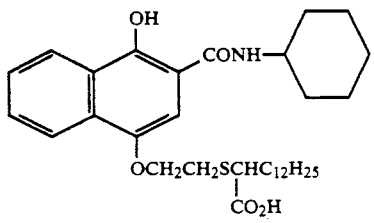

C-6

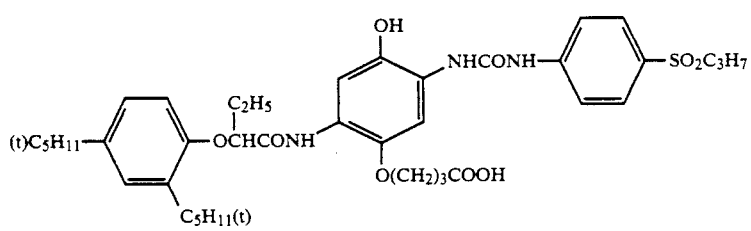

C-7

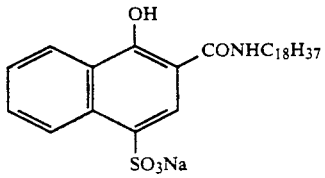

C-8

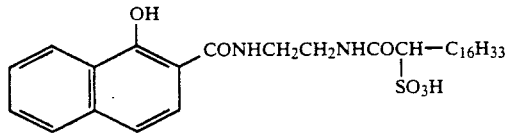

Of the couplers to be used in the present invention, the first coupler should desirably be slow particularly in the developing initial reaction, while the second coupler rapid particularly in the developing initial reaction.

As the first coupler slow in the developing initial reaction, a 4-equivalent type coupler highly compatible with a high boiling solvent may be preferred, with its color density being 0.01 or lower when measured according to the method as hereinafter described, preferably entirely without color formation during 10" development. Such first couplers slow in developing initial reaction may include the exemplary couplers y - 1, y - 2, m - 5, m - 6, c - 4 and c - 5.

On the other hand, the second coupler rapid in developing initial reaction may be a coupler having a color density of 0.03 or more, preferably 0.07 or more, when measured according to the method as hereinafter described. More specifically, there may be included the exemplary couplers Y - 1, Y - 2, Y - 3, M - 1, M - 2, M - 3, M - 4, C - 1 and C - 2, which are not limitative of the present invention.

The method for measurement of the "developing initial reaction" is described below.

First, an emulsion comprising 0.01 mole (0.02 mole in the case of a divalent coupler) of a coupler added to 1 mole of a high sensitivity silver iodobromide (4 mole % of silver iodide; mean grain size 0.9 μm) was coated onto a cellulose triacetate base to an amount of silver coated of 1.6 g/m$^2$ and a gelatin amount of 1.6 g/m$^2$, followed by drying. The photographic film piece obtained is subjected to exposure of 1.6 CMS, and then the following processings are conducted (processing temperature 38° C.).

During color developing, the film piece is stationarily

| | |
|---|---|
| (1) Color developing | 10 sec. |
| (2) Bleaching | 6 min. |
| (3) Water washing | 3 min. |
| (4) Fixing | 6 min. |
| (5) Water washing | 3 min. |
| (6) Stabilizing | 3 min. |

The compositions of the processing solutions to be used for respective steps are shown below.

| | |
|---|---|
| Color developing solution: | |
| 4-(N-ethyl-N-β-hydroxyethylamino)-2-methylaniline sulfate | 4.5 g |
| Anhydrous sodium sulfite | 4.0 g |
| Sodium nitrilotriacetate | 1.0 g |
| Sodium carbonate | 30.0 g |
| Potassium bromide | 1.4 g |
| Hydroxylamine sulfate | 2.4 g |
| (made up to 1 liter with addition of water.) | |
| Bleaching solution: | |

-continued

| | |
|---|---|
| Ammonium bromide | 160.0 g |
| Ferric ammonium ethylenediamine-tetraacetate | 110.0 g |
| Glacial acetic acid (added with water to one liter, and adjusted to pH 6.0 with ammonia water (28%)) | 10.0 ml |
| Fixing solution: | |
| Ammonium thiosulfate (70%) solution | 175.0 g |
| Anhydrous sodium sulfite | 8.6 g |
| Sodium metalsulfite (added with water to one liter, and adjusted to pH 6.0 with acetic acid) | 2.3 g |
| Stabilizing solution: | |
| Formalin (37% aqueous solution) | 1.5 ml |
| Konidax (produced by Konishiroku Photo Industry, Co., Ltd.) (added with water to one liter.) | 7.5 ml |

The density of the piece obtained is measured.

As the method for dispersing each of the first coupler and the second coupler, known methods can be employed. For carrying out oil droplet dispersion of the first coupler, the methods as described in Japanese Provisional Patent Publications Nos. 102234/1984, 105645/1984 and 09055/1984 may be applicable.

For example, a silver halide emulsion to be used in the present invention can be prepared by dissolving a coupler in a high boiling point organic solvent such as phthalic acid esters (e.g. dibutyl phthalate, dioctyl phthalate, etc.), phosphoric acid esters (tricresyl phosphate, trioctyl phosphate, etc.), N-substituted acid amides (N,N-diethyllaurylamide, etc.), etc. alone or in a mixture with a low boiling point organic solvent, typically methyl acetate, ethyl acetate, propyl acetate, butyl acetate, butyl propionate, cyclohexanol, cyclohexane, tetrahydrofuran, methyl alcohol, acetonitrile, dimethylformamide, dioxane, methyl ethyl ketone, methyl isobutyl ketone, diethylene glycol monoacetate, acetylacetone, nitromethane, carbon tetrachloride, chloroform, etc., then mixing with an aqueous gelatin solution containing a surfactant and subsequently emulsifying the mixture by means of a dispersing means such as a stirrer, a homogenizer, a colloid mill, a flow jet mixer, an ultrasonic dispersing means, etc., followed by addition of the emulsion into a silver halide emulsion. It is also possible to incorporate the step of removing the low boiling point solvent after or simultaneously with dispersion. Here, the ratio of the high boiling point organic solvent to the low boiling point organic solvent may preferably 1:0.1 to 1:50, more preferably 1:1 to 1:20.

As the oil droplet dispersing aid in this case, surfactants as described in Japanese Provisional Patent Publication No. 105645/1984 may be used. Such surfactants may include, for example, anionic surfactants such as alkylbenzene sulfonates, alkylnaphthalene sulfonates, alkylsulfonates, alkylsulates, alkylphosphates, sulfosuccinates and sulfoalkylpolyoxyethylene alkylphenyl ethers, etc.; nonionic surfactants such as steroid type saponins, alkylene oxide derivatives and glycidol derivatives; amphoteric surfactants such as amino acids, aminoalkyl sulfonic acids and alkyl betains, and cationic surfactants such as quaternary ammonium salts. Examples of these surfactants are described in "Handbook of Surfactants" (published by Sangyo Tosho, 1966) or "Studies of Emulsifiers and Emulsifying Devices; Technical Data Systems" (published by Kagaku Hanron Co., 1978).

On the other hand, for carrying out an aqueous alkali dispersion of the second coupler, there may be employed the method as described in Japanese Provisional Patent Publication No. 60437/1984, etc. In this case, since the coupler has an acid group such as carboxylic acid or sulfonic acid, it may be introduced into a hydrophilic colloid as an alkaline aqueous solution.

The amount of the coupler added may desirably be such that the total amount of the couplers may be 0.017 mole or more per one mole of the silver halide.

Next, the diffusible DIR coupler to be used in the present invention is to be described.

For enhancing the sharpness at the low frequency region, namely the MTF value (particularly 1.15 or higher), it is desirable that a developing inhibiting substance with a diffusion degree as described hereinafter of 0.4 or higher should be released or eliminated directly or indirectly from the coupler through the coupling reaction. The diffusion degree of the developing inhibiting substance is measured according to the method described below.

First, respective layers with the following compositions are successively provided on a transparent support to prepare Sample I.

First layer: red-sensitive silver halide emulsion layer

Red are sensitivity is imparted with the use of $6\times10^{-5}$ mole of the sensitizing dye I as hereinafter described to a silver iodobromide emulsion (silver iodide 5 mole %, mean size 0.4 μm), and the gelatin coating solution containing the emulsion and 0.0015 mole of the coupler A shown below per mole of silver was coated to a silver quantity of 1.8 g/m$^2$ (film thickness 2 μm).

Coupler A

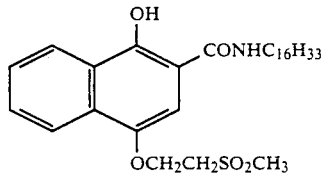

Second layer:

A gelatin layer (silver quantity 2 g/m$^2$, film thickness 1.5 μm) containing the silver iodobromide emulsion before sensitization used in the first layer and polymethyl methacrylate particles (diameter: about 1.5 μm).

Further, in each layer, a gelatin hardening agent and a surfactant are contained.

Sample II is prepared in the same manner as Sample I except for omitting the silver iodobromide in the second layer. After wedge exposure of the both samples, the following development processing is performed.

| Development processing (38° C.) | |
|---|---|
| 1. Color developing | 2 min. 10 sec. |
| 2. Bleaching | 6 min. 30 sec. |
| 3. Water washing | 3 min. 15 sec. |
| 4. Fixing | 6 min. 30 sec. |
| 5. Water washing | 3 min. 15 sec. |
| 6. Stabilizing | 3 min. 15 sec. |

Compositions of processing solutions:

| Color developing solution: | |
|---|---|
| Sodium nitrilotriacetate | 1.0 g |
| Sodium sulfite | 4.0 g |
| Sodium carbonate | 30.0 g |
| Potassium bromide | 1.4 g |

-continued

| | |
|---|---|
| Hydroxylamine sulfate | 2.4 g |
| 4-(N-ethyl-N-β-hydroxylethylamino)-2-methyl-aniline sulfate | 4.5 g |
| Development inhibiting substance | an amount which makes the conc. of Sample II ½ |
| (made up to 1 liter with addition of water.) | |
| Bleaching solution: | |
| Ammonium bromide | 160.0 g |
| Ammonia water (28%) | 25.0 ml |
| Ferric ammonium ethylenediamine-tetraacetate | 130 g |
| Glacial acetic acid | 14 ml |
| (made up to 1 liter with addition of water.) | |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| (made up to 1 liter with addition of water.) | |
| Stabilizing solution: | |
| Formalin | 8.0 ml |
| (made up to 1 liter with addition of water.) | |

The diffusibility of the development inhibiting substance is determined based on the concentration reduction of Sample I. That is, when the concentration reduction of Sample I is defined as $\Delta n_I(\%)$ and that of Sample II as $\Delta n_{II}(\%)$ as the result of processing with the developing solution, the diffusion degree of the development inhibiting substance is represented as follows:

$$\text{Diffusion degree} = \Delta n_I / \Delta n_{II}.$$

The diffusion degrees of some development inhibiting substances are exemplified below.

| Development inhibiting substance | Diffusion degree |
|---|---|
| 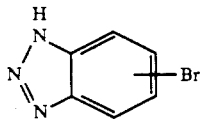 | 0.87 |
| 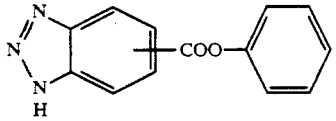 | 0.72 |
| 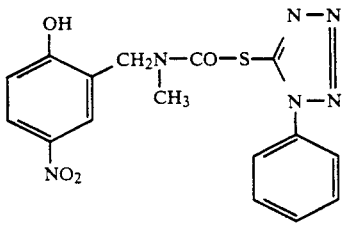 | 0.49 |
| 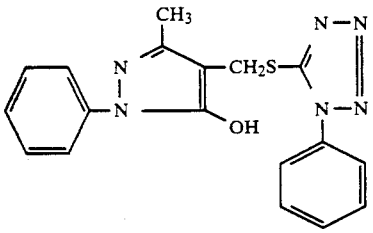 | 0.44 |
| 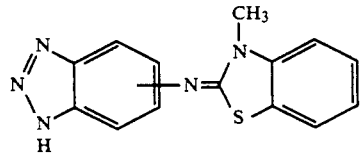 | 0.32 |
| 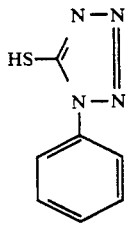 | 0.21 |

The (DIR) coupler capable of eliminating the development inhibiting substance with a diffusion degree of 0.4 or higher is represented by the following formula (IX):

$$A\text{—}(Y)_m \qquad (IX)$$

In the above formula, A represents a coupler component and Y is a development inhibitor or a group containing it which is bonded at the coupling position of A, and m is 1 or 2.

Here, A may be one which can be coupled with the oxidized product of a color developing agent, irrespectively of whether it may form a dye as the result of the coupling reaction.

Y in the above formula (IX) may include those represented by the formulae (Xa) to (XIII) shown below:

(Xa)

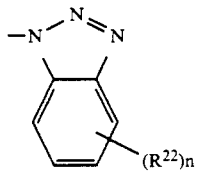

(Xb)

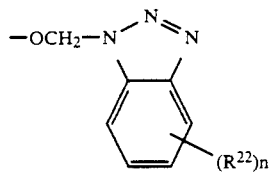

(Xc)

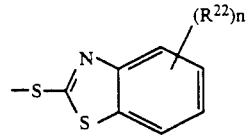

(Xd)

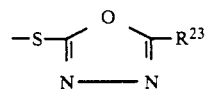

(Xe)

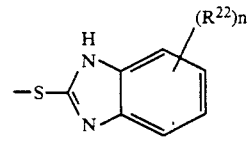

-continued (XI)

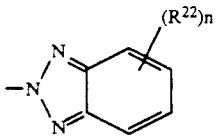

(XII)

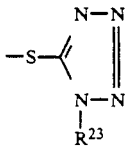

(XIII)

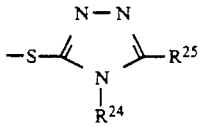

$R^{22}$ represents an alkyl group, an alkoxy group, an acylamino group, a halogen atom, an alkoxycarbonyl group, an aryloxycarbonyl group, a thiazolylideneamino group, an acyloxy group, a carbamoyl group (inclusive of N-alkylcarbamoyl, N,N-dialkylcarbamoyl, etc.), a nitro group, an amino group, a carbamoyloxy group (inclusive of N-arylcarbamoyloxy, N-alkylcarbamoyloxy, etc.), a hydroxy group, a sulfamoyl group, an alkoxycarbonylamino group, an alkylthio group, an arylthio group, an aryl group, a heterocyclic group, a cyano group, an alkylsulfonyl group or an aryloxycarbonylamino group.

n represents an integer of 0 to 4, and, when n is 2 or more, $R^{22}$ may be either identical or different. The number of carbon atoms included in $R^{22}$ groups in number of n may be 0 to 10 as a total.

$R^{23}$ represents an alkyl group, an aryl group or a heterocyclic group. The total number of carbon atoms in $R^{23}$ may be 1 to 15.

$R^{24}$ represents a hydrogen atom, an alkyl group, an aryl group or a heterocyclic group. $R^{25}$ represents a hydrogen atom, an alkyl group, an aryl group, a halogen atom, an amino group, an acylamino group, an alkoxycarbonylamino group, an aryloxycarbonylamino group, an alkanesulfonamide group, a cyano group, a heterocyclic group or an alkylthio group. The total number of carbon atoms in $R^{24}$ and $R^{25}$ may be 1 to 15.

When $R^{22}$, $R^{23}$, or $R^{25}$ is an alkyl group, it may be either substituted or unsubstituted, and either chained or cyclic. The substituents may include a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkylsulfonyl group, an arylsulfonyl group, an alkylthio group and an arylthio group.

When $R^{22}$, $R^{23}$, $R^{24}$ or $R^{25}$ is an aryl group, said aryl group may have substituents, including an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an acylamino group, a cyano group and a uredo group.

When $R^{22}$, $R^{23}$, $R^{24}$ or $R^{25}$ is a heterocyclic group, the hetero atom may be preferably nitrogen atom, oxygen atom or sulfur atom, and the ring may be preferably 5- or 6-membered, and it may also be a fused ring. The heterocyclic group may include, for example, a pyridyl group, a quinolyl group, a furyl group, a benzothiazolyl group, an oxazolyl group, an imidazolyl group, a thiazolyl group, a triazolyl group, a benzotriazolyl group, an imide group and an oxazine group, and these groups may also have substituents. As the substituents, there may be included those as mentioned for the above aryl group. Other preferable Y in the formula (IX) may be represented by the following formula (XIV):

$$-T-DI \qquad (XIV)$$

In the above formula, the group T is bonded to the coupling position of A and is cleavable through the reaction with the oxidized product of a color developing agent, and the group DI represents a development inhibitor residue. The compound releases indirectly the development inhibitor. That is, through the reaction with the oxidized product of a color developing agent, cleavage occurs between A and T, and thereafter the group DI is released while being controlled adequately.

Preferable T-DI groups may include those represented by the formulae (XV) to (XXI) shown below:

(XV)

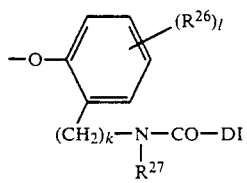

(XVI)

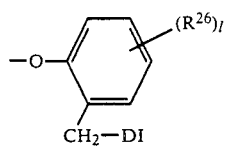

(XVII)

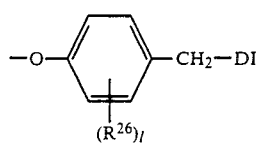

(XVIII)

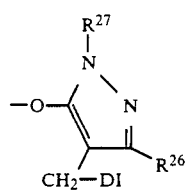

(XIX)

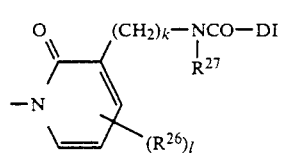

(XX)

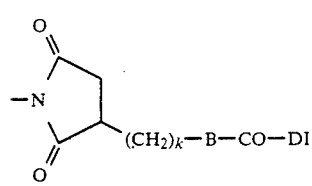

-continued (XXI)

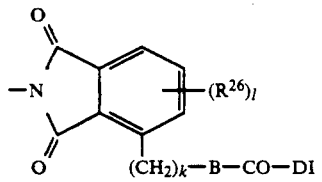

$R^{26}$ represents a hydrogen atom, a halogen atom, an alkyl group (inclusive of aralkyl group), an alkoxy group, an alkenyl group, an alkoxycarbonyl group, an anilino group, an acylamino group, a ureido group, a cyano group, a nitro group, a sulfonamide group, a sulfamoyl group, a carbamoyl group, an aryl group, a carboxy group, a sulfo group, a hydroxy group or an alkylsulfonyl group.

$R^{27}$ represents an alkyl group (inclusive of an aralkyl group), a cycloalkyl group, an alkenyl group or an aryl group.

B represents an oxygen atom or

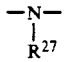

($R^{27}$ is the same as defined above.).

DI group is the same as the definition in the formulae (Xa) to (Xe), (XI), (XII) and (XIII) except for the carbon number.

The number of carbon atoms contained in $(R^{22})_n$ in the formulae (Xa), (Xb), (Xc), (Xe) and (XI) may be 1 to 32, while the number of carbon atoms contained in $R^{23}$ in the formulae (Xd) and (XII) may be 1 to 32, and the total number of carbon atoms contained in $R^{24}$ and $R^{25}$ in the formula (XIII) may be 1 to 32.

When $R^{26}$ and $R^{27}$ are alkyl groups, they may be either chained or cyclic, and may also have substituents as enumerated when $R^{22}$ to $R^{25}$ are alkyl groups.

When $R^{26}$ and $R^{27}$ are aryl groups, said aryl groups may have substituents, examples of which may include those as enumerated when $R^{22}$ to $R^{25}$ are aryl groups.

k is an integer of 0 to 2, and l is an integer of 1 to 2.

Of the above diffusible DIR couplers, those having groups represented by the formulae (Xa), (Xb) or (XIII) are particularly preferred.

The yellow coupler residues represented by A may include residues of the pivaloylacetanilide type, the benzoylacetanilide type, the malonic diester type, the malonic diamide type, the dibenzoylmethane type, the benzothiazolyl acetamide type, the malonic ester monoamide type, the benzothiazolyl acetate type, the benzoxazolyl acetamide type, the benzoxazolyl acetate type, the malonic diester type, the benzimidazolyl acetamide type or the benzimidazolyl acetate type, residues derived from heterocyclic substituted acetamides or heterocyclic substituted acetates included in U.S. Pat. No. 3,841,880, residues derived from acylacetamides disclosed in U.S. Pat. No. 3,770,446, U.K. Pat. No. 1,459,171, West German OLS No. 2,503,099, Japanese Provisional Patent Publication No. 139,738/1975 or Research Disclosure No. 15737, and heterocyclic residues as disclosed in U.S. Pat. No. 4,046,574.

The magenta coupler residues represented by A may preferably be those having 5-oxo-2-pyrazoline nucleus, pyrazolo-[1,5-a]benzimidazole nucleus or cyanoacetophenone type coupler residues.

The cyan coupler residues represented by A may preferably be coupler residues having a phenol nucleus or an α-naphthol nucleus.

Further, as the coupler residues in the DIR couplers of the type which release development inhibitors through coupling reaction with the oxidized product of a developing agent but do not substantially form a dye, there may be included the coupler residues as disclosed in U.S. Pat. Nos. 4,052,213, 4,088,491, 3,632,345, 3,958,993 or 3,961,959.

While the diffusible DIR compound itself may preferably be one which will not be diffused through the light-sensitive material, the coupling product between the coupler component of the diffusible DIR compound and the oxidized product of a developing agent may be flowed out into the processing solutions during processing.

In the formula IX, A may represent the formulae (XXII), (XXIII), (XXIV), (XXV), (XXVI), (XXCII), (XXVIII), (XXIX) and (XXX).

(XXII)

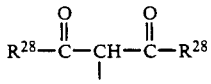

(XXIII)

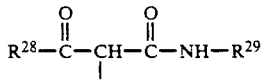

(XXIV)

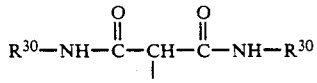

(XXV)

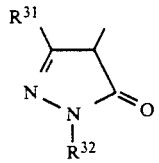

(XXVI)

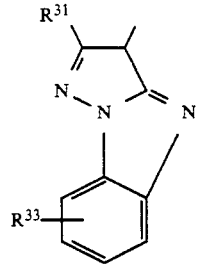

(XXVII)

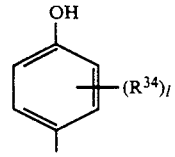

(XXVIII)

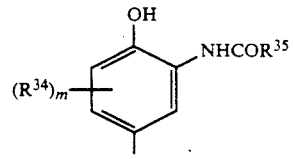

-continued

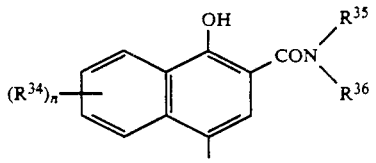

(XXIX)

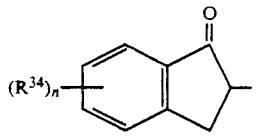

(XXX)

In these formulae, $R^{28}$ represents an aliphatic group, an aromatic group, an alkoxy group or a heterocyclic group, and $R^{29}$ and $R^{30}$ represent aromatic groups or heterocyclic groups.

The aliphatic group represented by $R^{28}$ may preferably have 1 to 22 carbon atoms, and may be either chained or cyclic, optionally having substituents. Preferred substituents may include alkoxy groups, aryloxy groups, amino group, acylamino groups, halogen atoms, etc. and these may further have substituents. Examples of available aliphatic groups as $R^{28}$ may include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

The aromatic group represented by $R^{28}$, $R^{29}$ or $R^{30}$ may be substitued. The aromatic group such as a phenyl group may be substituted with substituents having 32 or less carbon atoms such as an alkyl group, an alkenyl group, an alkoxy group, an alkoxycarbonyl group, an aliphatic amide group, an alkylsulfamoyl group, an alkylsulfonamide group, an alkylureido group, an alkyl-substituted succinimide group, etc., and, in this case, the alkyl groups may also have aromatic groups such as phenylene in the chain. The phenyl group may also be substituted with an aryloxy group, an aryloxycarbonyl group, an arylcarbamoyl group, an arylamide group, an arylsulfamoyl group, an arylsulfonamide group, an arylureido group, etc., and the aryl moiety of these substituents may further be substituted with at least one alkyl groups of which the total number of carbon atoms is 1 to 22.

The phenyl group represented by $R^{28}$, $R^{29}$ or $R^{30}$ may be further substituted with an amino group which may be substituted with a lower alkyl group having 1 to 6 carbon atoms, a hydroxy group, a carboxy group, a sulfo group, a nitro group, a cyano group, a thiocyano group or a halogen atom.

Also, $R^{28}$, $R^{29}$ or $R^{30}$ may also be a phenyl group fused with other rings such as a naphthyl group, a quinolyl group, an isoquinolyl group, a chromanyl group, a coumaranyl group, a tetrahydronaphthyl group, etc. These groups themselves may also have substituents.

When $R^{28}$ represents an alkoxy group, its alkyl moiety represents a straight or branched alkyl group, an alkenyl group, a cyclic alkyl group or a cyclic alkenyl group having 1 to 40, preferably 1 to 22 carbon atoms, and these may be also substituted with halogen atoms, aryl groups, alkoxy groups, etc.

When $R^{28}$, $R^{29}$ or $R^{30}$ represents a heterocyclic group, each heterocyclic group is bonded through one of the carbon atoms forming the ring to the carbon atom of the carbonyl group of the acyl group or the nitrogen atom of the amide group in the alpha-acylacetamide. Examples of such a heterocyclic ring are thiophen, furan, pyrane, pyrrole, pyrazole, pyridine, pyrazine, pyrimidine, pyridazine, indolidine, imidazole, thiazole, oxazole, triazine, thiadiazine, oxazine and the like. These may further have substituents on the ring.

In the formula (XXV), $R^{32}$ represents a straight or branched alkyl group having 1 to 40, preferably 1 to 22 carbon atoms (e.g. methyl, isopropyl, tert-butyl, hexyl, dodecyl groups, etc.), an alkenyl group (e.g. an allyl group), a cyclic alkyl group (e.g. a cyclopentyl group, a cyclohexyl group, a norbornyl group, etc.), an aralkyl group (e.g. benzyl, β-phenylethyl groups, etc.), a cyclic alkenyl group (e.g. cyclopentenyl, cyclohexenyl groups, etc.), and these may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamyol group, an acylamino group, a diacylamino group, a ureido group, a urethane group, a thiourethane group, a sulfonamide group, a heterocyclic group, an arylsulfonyl group, an alkylsulfonyl group, an arylthio group, an alkylthio group, an alkylamino group, an dialkylamino group, an anilino group, an N-arylanilino group, an N-alkylanilino group, an N-acylanilino group, a hydroxy group, a mercapto group or others.

Further, $R^{32}$ may also represent an aryl group (e.g. a phenyl group, an α- or β-naphthyl group, etc.). The aryl group may have at least one substituent, and the substituent may include, for example, an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamide group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group or others. More preferably, $R^{32}$ may be a phenyl group of which at least one hydrogen at orthopositions is substituted with an alkyl group, an alkoxy group or a halogen atom, and this is useful with little coloration of the remaining coupler in the film by light or heat.

Further, $R^{32}$ may also represent a heterocyclic group (e.g. a 5- or 6-membered hetero ring or fused heterocyclic group containing nitrogen atom, oxygen atom or sulfur atom as the hetero atom, such as a pyridiyl group, a quinolyl group, a furyl group, a benzothiazolyl group, an oxazolyl group, an imidazolyl group, a naphthoxazolyl group, etc.), a heterocyclic group substituted with substituents as enumerated for the above aryl groups, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R^{31}$ represents a hydrogen atom, a straight or branched alkyl group having 1 to 40 carbon atoms, preferably 1 to 22 carbon atoms, an alkenyl group, a cyclic alkyl group, an aralkyl group or a cyclic alkenyl group (these groups may have substituents as enumerated for the above $R^{32}$), an aryl group and a heterocyclic group (these may have substituents as enumerate for the above $R^{32}$), an alkoxycarbonyl group (e.g. a methoxycarbonyl group, an ethoxycarbonyl group, a stearyloxycarbonyl group, etc.), an aryloxycarbonyl group (e.g. a phenoxycarbonyl group, a naphthoxycarbonyl group, etc.), an aralkyloxycarbonyl group (e.g. a benzyloxycarbonyl group, etc.), an alkoxy group (e.g. a methoxy group, an ethoxy group, a heptadecyloxy group, etc.), an aryloxy group (e.g. a phenoxy group, a tolyloxy group, etc.), an alkylthio group (e.g. an ethylthio group, a dodecylthio group, etc.), an arylthio thio group (e.g. a phenylthio group, an α-naphthylthio group, etc.), a carboxy group, an acylamino group (e.g. an acetylamino group, a 3-[(2,4-di-tert-amylphenoxy)-acetamido]benzamide group, etc.), a diacylamino group, an N-alklylacylamino group (e.g. an N-methylpropionamide group, etc.), an N-arylacylamino group (e.g. an N-phenylacetamide group, etc.), a ureido group (e.g. a ureido group, an N-arylureido group, an N-alkylureido group, etc.), a urethane group, a thiourethane group, an arylamino group (e.g. a phenylamino group, an N-methylanilino group, a diphenylamino group, an N-acetylanilino group, a 2-chloro-5-tetradecaneamidoanilino group, etc.), an alkylamino group (e.g. an n-butylamino group, a methylamino group, a cyclohexylamino group, etc.), a cycloamino group (e.g. a piperidino group, a pyrrolidino group, etc.), a heterocyclic amino group (e.g. a 4-pyridylamino group, a 2-benzoxazolylamino group, etc.), an alkylcarbonyl group (e.g. a methylcarbonyl group, etc.), an arylcarbonyl group (e.g. a phenylcarbonyl group, etc.), a sulfonamide group (e.g. an alkylsulfonamide group, an arylsulfonamide group, etc.), a carbamoyl group (e.g. an ethylcarbamoyl group, a dimethylcarbamoyl group, an N-methyl-phenylcarbamoyl group, an N-phenylcarbamoyl group, etc.), a sulfamoyl group (e.g. an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group.

$R^{33}$ represents a hydrogen atom, a straight or branched alkyl group having 1 to 32, preferably 1 to 22 carbon atoms, an alkenyl group, a cyclic alkyl group, an aralkyl group or a cyclic alkenyl group, and these may also have substituents as enumerated for the above $R^{32}$.

Also, $R^{33}$ may represent an aryl group or a heterocyclic group, and these may also have substituents as enumerated for the above $R^{32}$.

Also, $R^{33}$ may represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamide group, an arylsulfonyl group, an alkylsulfonyl group, an arylthio group, an alkylthio group, an alkylamino group, a dialkylamino group, an anilino group, an N-arylanilino group, an N-alkylanilino group an N-acylanilino group, a hydroxy group or a mercapto group.

Each of $R^{34}$, $R^{35}$ and $R^{36}$ represents a group to be used in conventional tetravalent type phenol or α-naphthol couplers. More specifically, $R^{34}$ may include a hydrogen atom, halogen atoms, aliphatic hydrocarbon residues, acylamino groups, —O—R—$^{37}$ or —S—$R^{37}$ (where $R^{37}$ is an aliphatic hydrocarbon residue). When two or more $R^{34}$ groups exist within the same molecule, they may be different groups, and the aliphatic hydrocarbon residues are also inclusive of those having substituents. $R^{35}$ and $R^{36}$ may include groups selected from aliphatic hydrocarbon residues, aryl groups and heterocyclic residues, or alternatively one of them may be a hydrogen atom, and these groups are inclusive of those having substituents. $R^{35}$ and $R^{36}$ may also be taken together to form a nitrogen-containing heterocyclic ring nucleus. l is an integer of 1 to 4, m is an integer of 1 to 3 and n is an integer of 1 to 5. And, the aliphatic hydrocarbon residue may be either saturated or unsaturated, and also either straight, branched or cyclic. And, it may preferably be an alkyl group (e.g. methyl, ethyl, propyl, isopropyl, butyl, t-butyl, isobutyl, dodecyl, octadecyl, cyclobutyl, cyclohexyl groups, etc.) or an alkenyl group (e.g. aryl, octenyl groups, etc.). As the aryl group, there may be included a phenyl group, a naphthyl group, etc., while typical examples of the heterocyclic residue may include pyridinyl, quinolyl, thienyl, piperidyl, imidazolyl groups and others. The substituents to be introduced into these aliphatic hydrocarbon residues, aryl groups and heterocyclic resides may include halogen atoms, nitro, hydroxy, carboxyl, amino, substituted amino, sulfo, alkyl, alkenyl, aryl, heterocyclic, alkoxy, aryloxy, arylthio, arylazo, acylamino, carbamoyl, ester, acyl, acyloxy, sulfonamide, sulfamoyl, sulfonyl, morpholino groups and others.

The substituents $R^{28}$, $R^{29}$, $R^{30}$, $R^{31}$, $R^{32}$, $R^{33}$, $R^{34}$, $R^{35}$ and $R^{36}$ of the couplers represented by the formulae from (XXII) to (XXIX) may be bonded to each other or any one of them may become a divalent group to form a symmetric or asymmetric complex coupler.

In the following, examples of the diffusible DIR couplers of the present invention are set forth, which are not limitative of the present invention.

DC-1
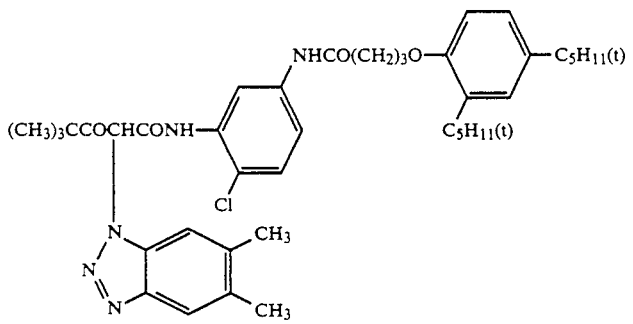
DC-2
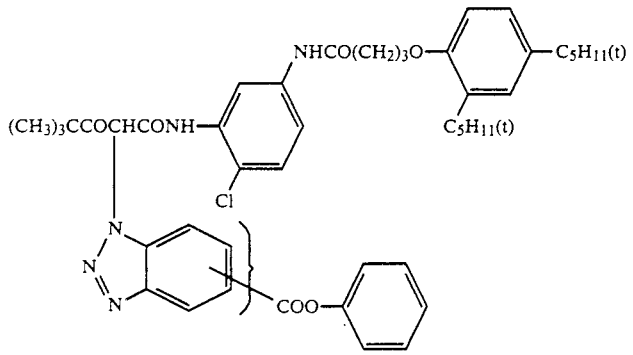
DC-3
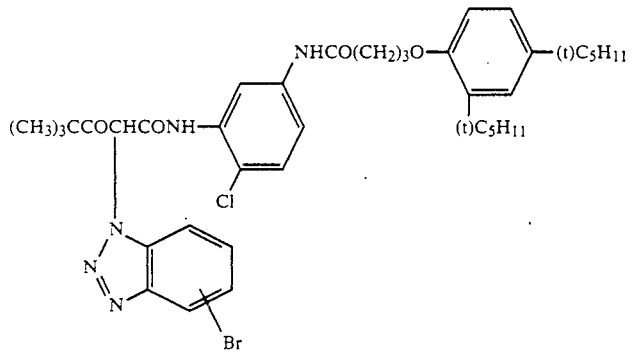
DC-4
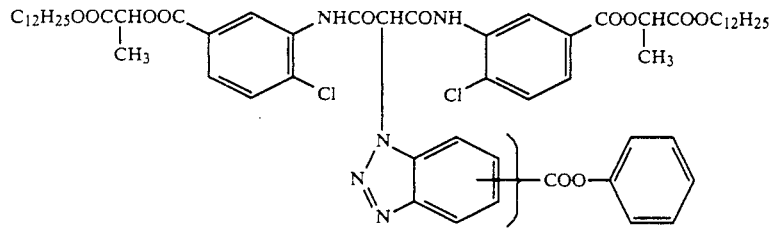
DC-5
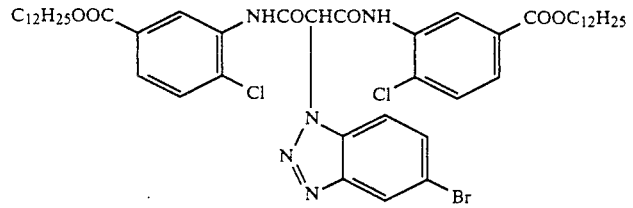

-continued
DC-6
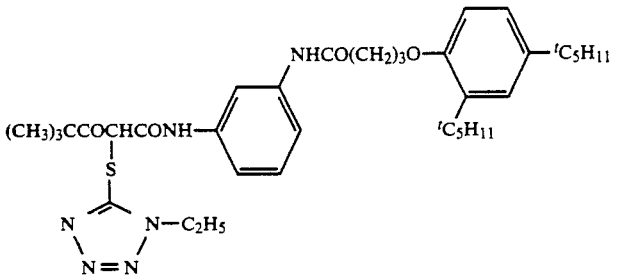
DC-7
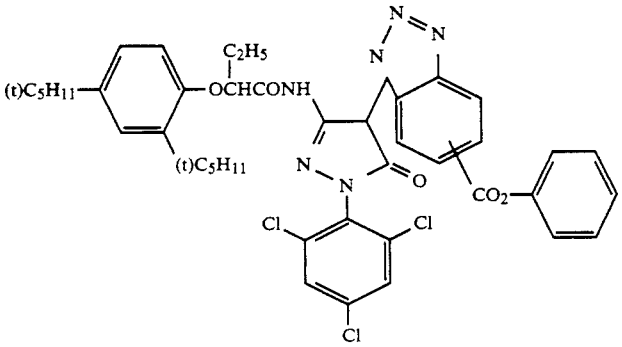
DC-8
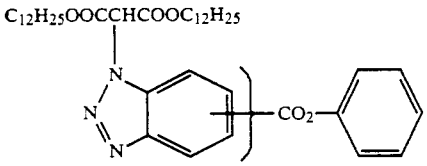
DC-9
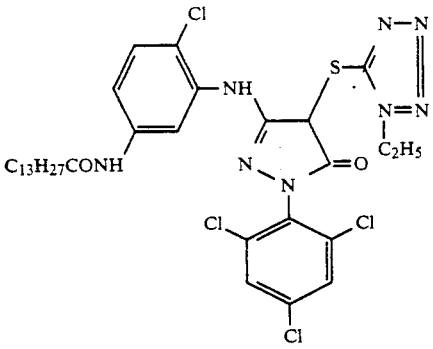
DC-10
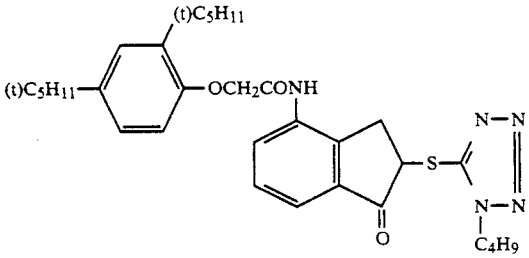

-continued
DC-11
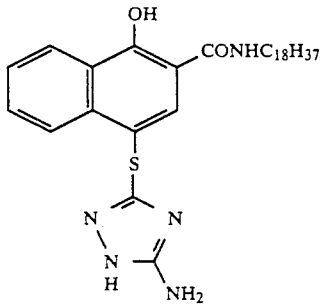
DC-12
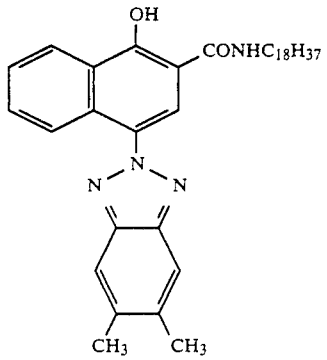
DC-13
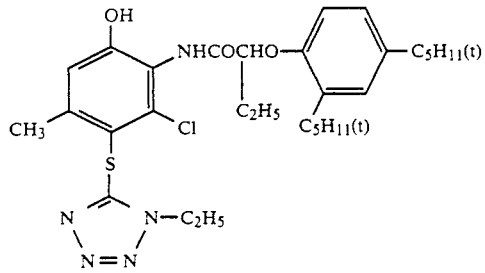
DC-14
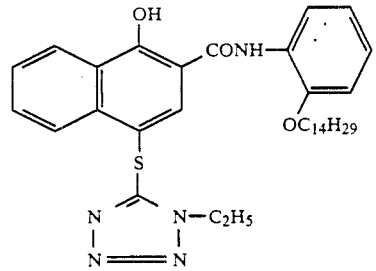
DC-15
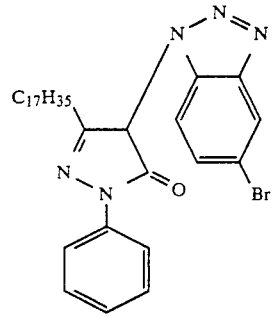

-continued
DC-16
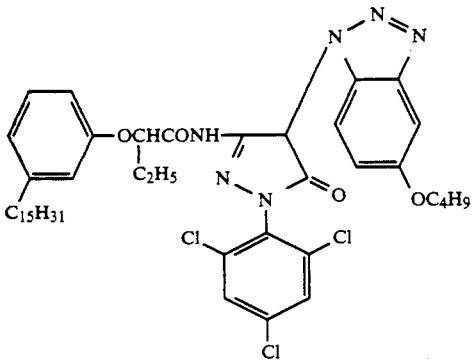
DC-17
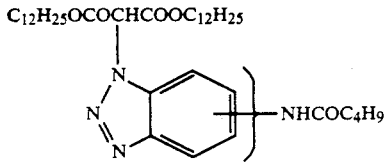
DC-18
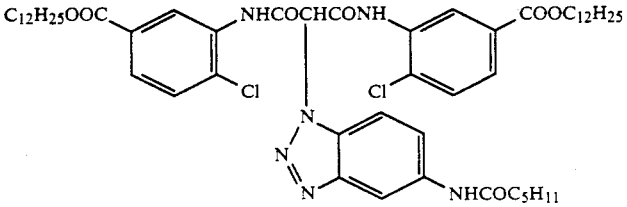
DC-19
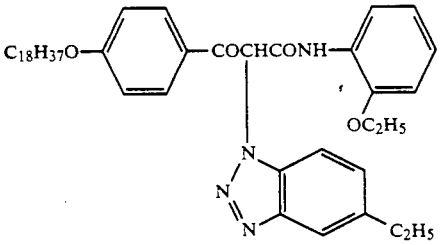
DC-20
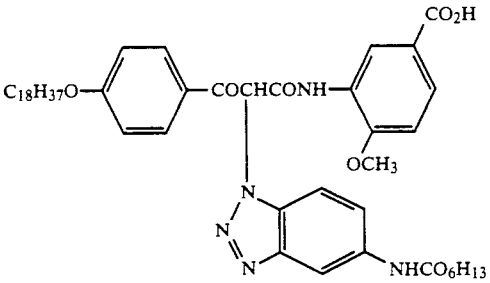
DC-21
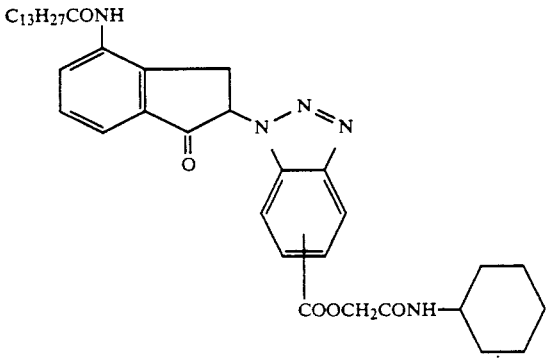

-continued
DC-22
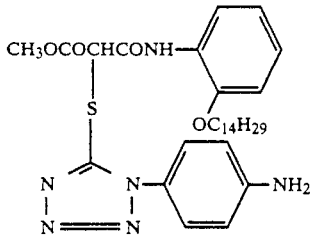
DC-23
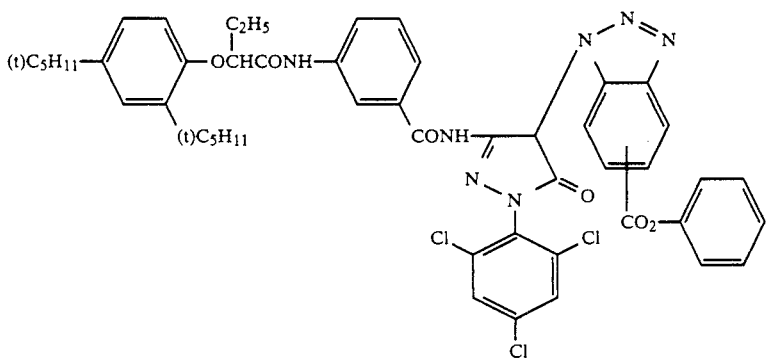
DC-24
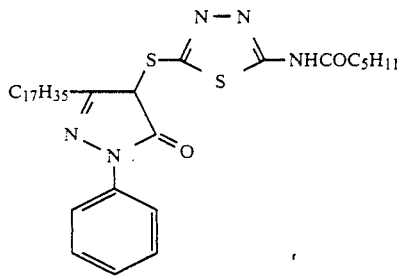
DC-25
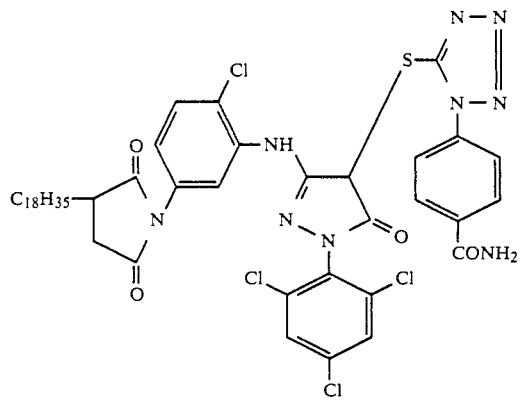
DC-26
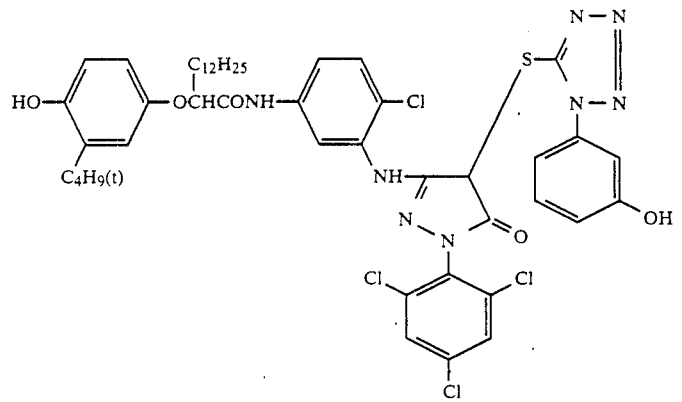

-continued
DC-27
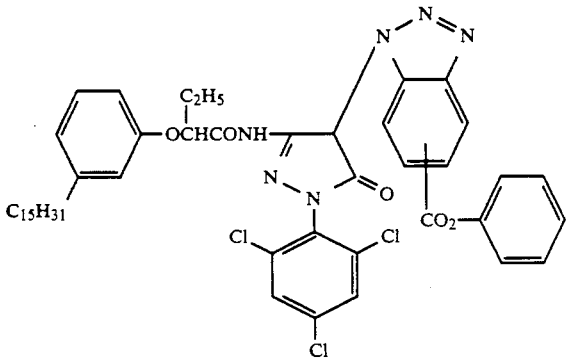
DC-28
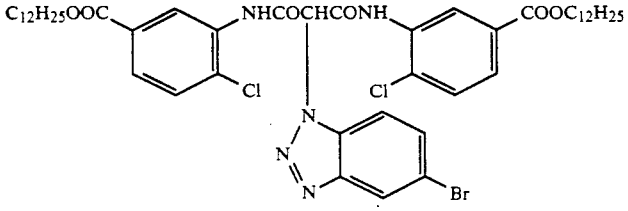
DC-29
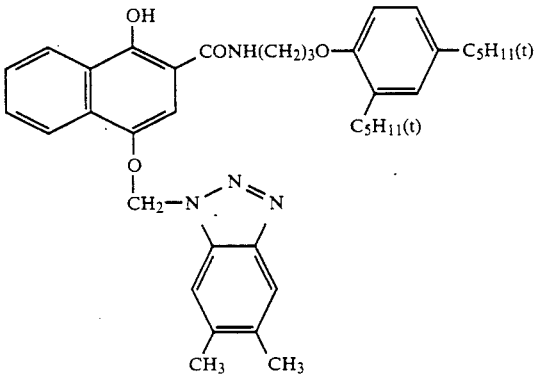
DC-30
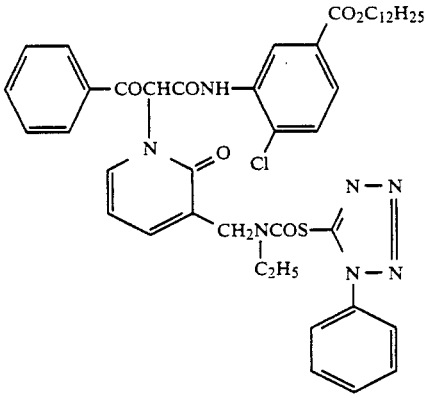

-continued
DC-31
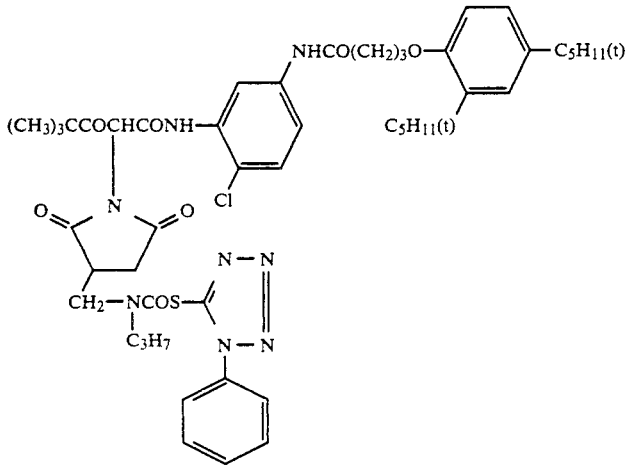
DC-32
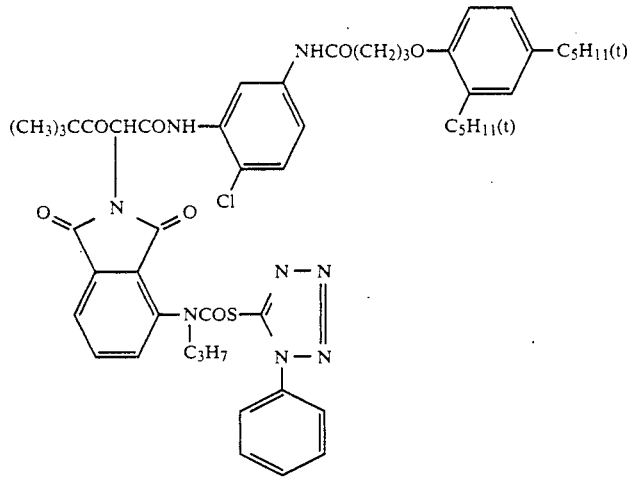
DC-33
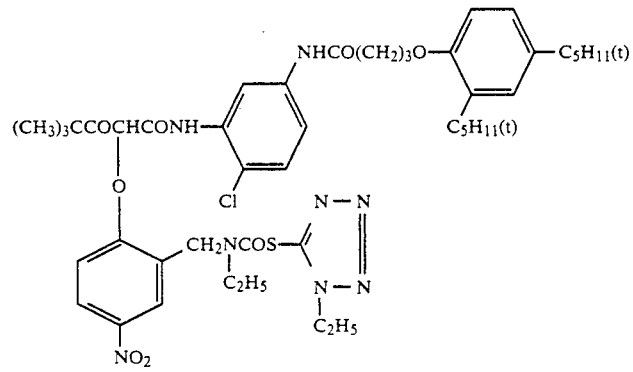

-continued
DC-34
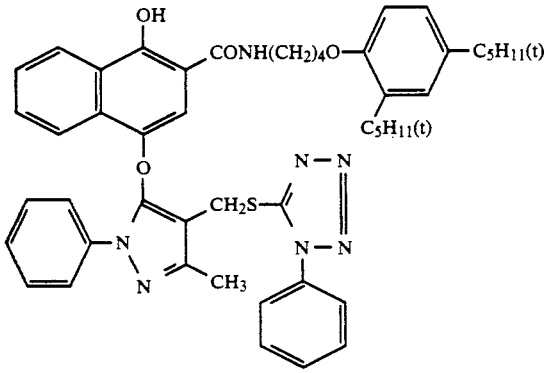
DC-35
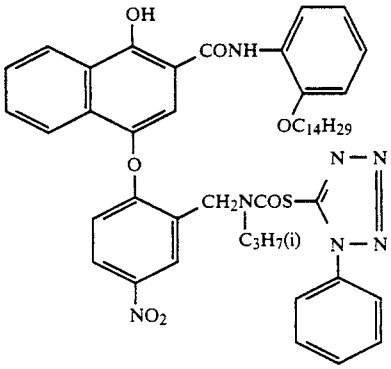
DC-36
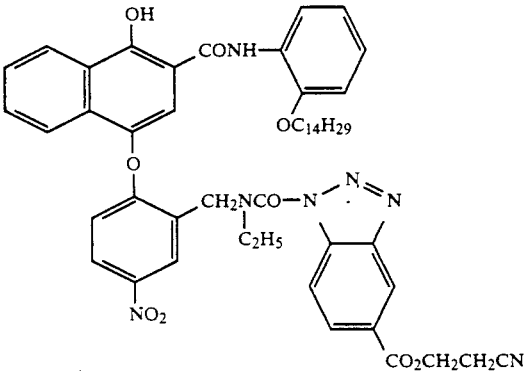
DC-37
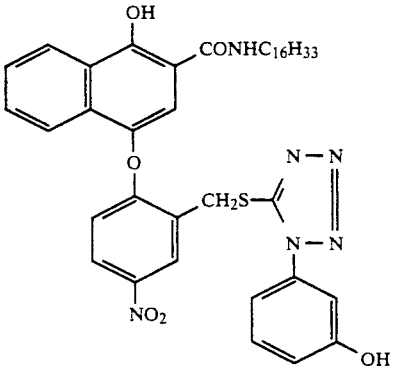

-continued
DC-38
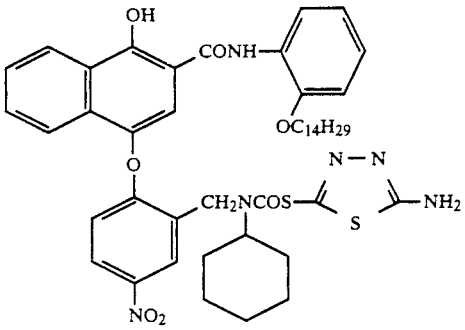
DC-39
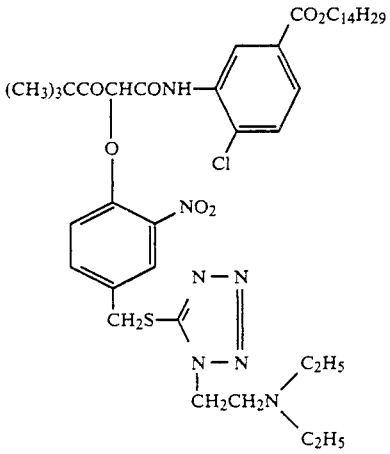
DC-40
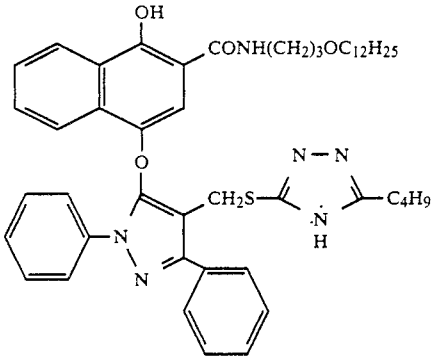
DC-41
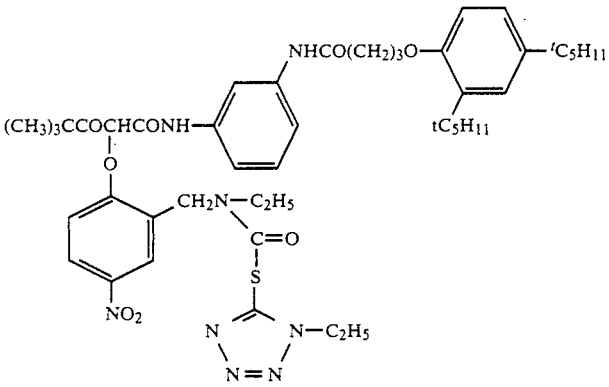

-continued
DC-42
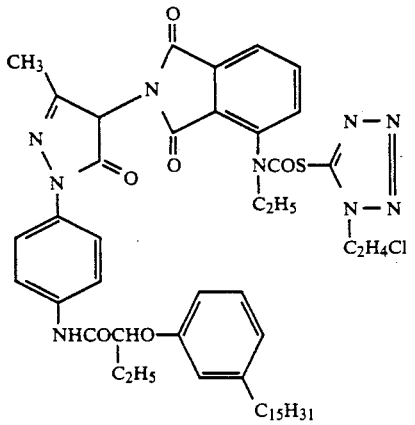
DC-43
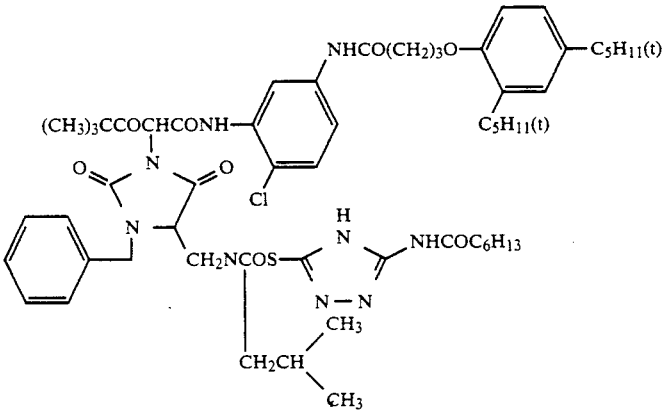
DC-44
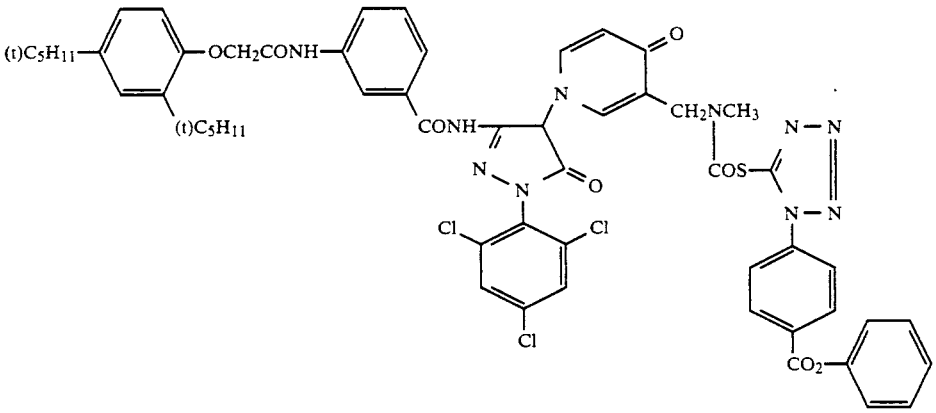
DC-45
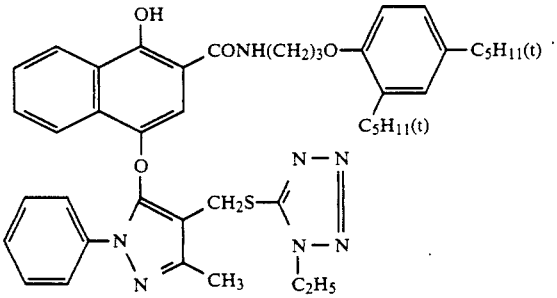

-continued
DC-46
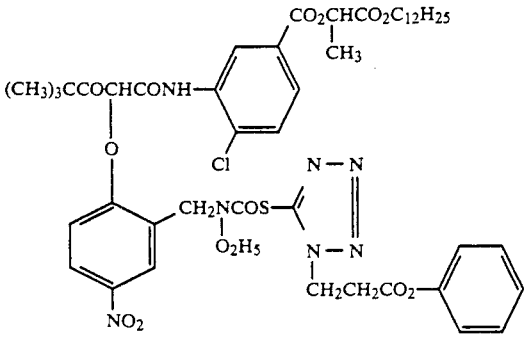
DC-47
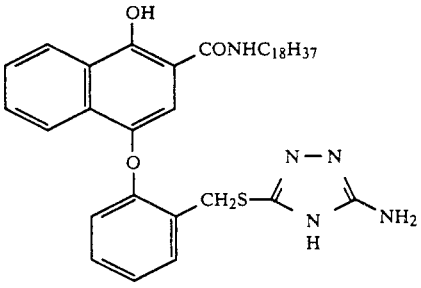
DC-48
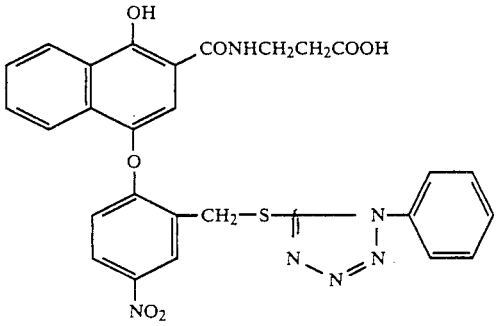
DC-49
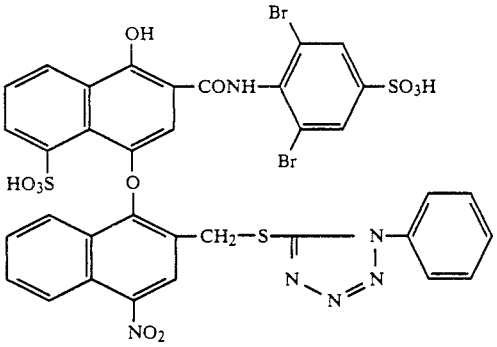
DC-50
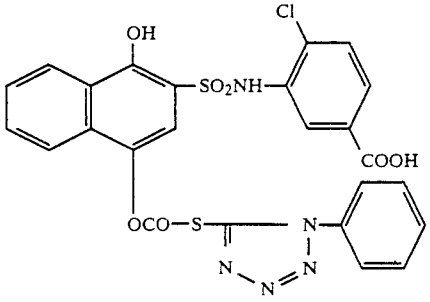

-continued
DC-51
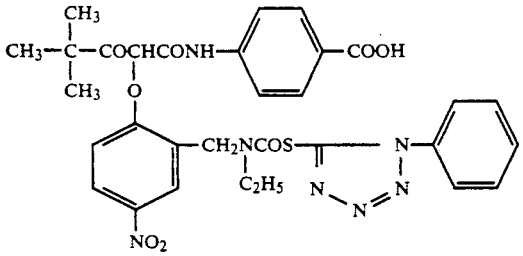
DC-52
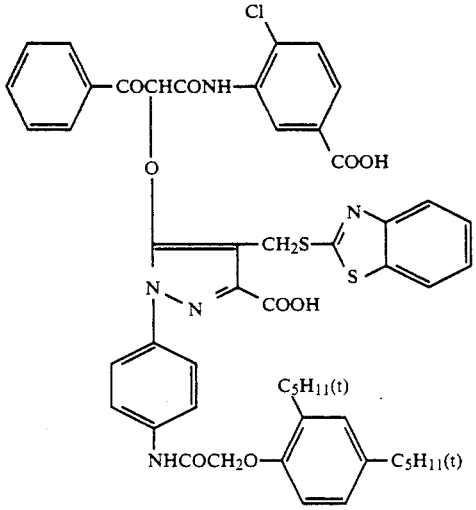
DC-53
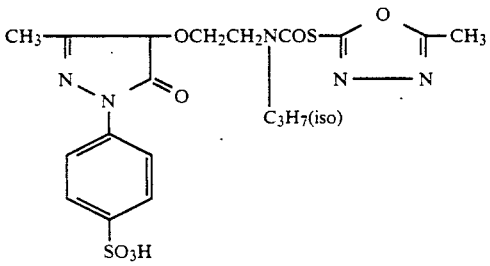
DC-54
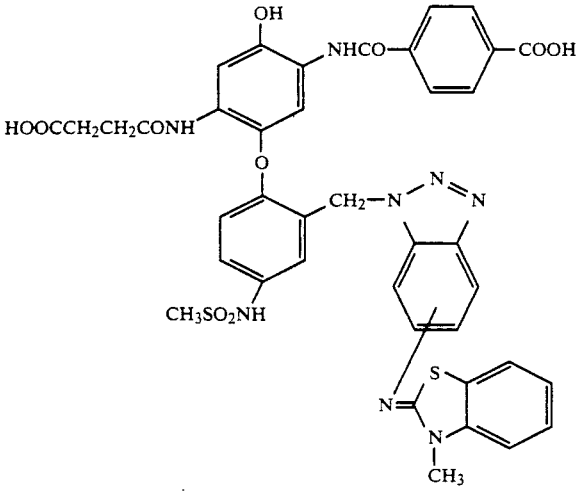

-continued

DC-55

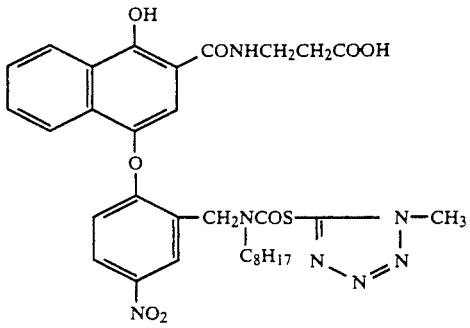

DC-56

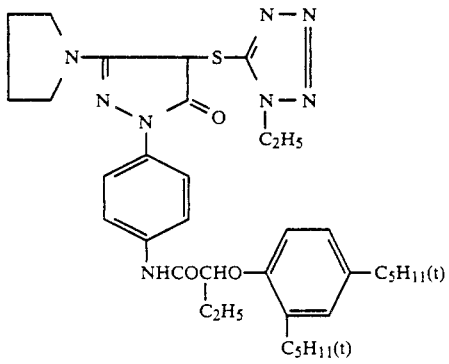

DC-57

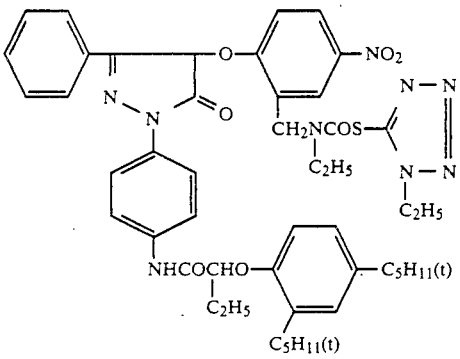

DC-58

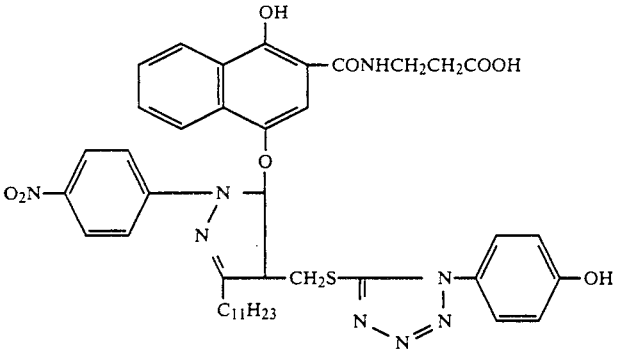

The above DIR couplers can be synthesized easily according to the methods as disclosed in U.S. Pat. Nos. 4,234,678, 3,227,554, 3,617,291, 3,958,993, 4,149,886 and 3,933,500; Japanese Provisional Patent Publications No. 56837/1982 and No. 13239/1976; U.K. Patents Nos. 2,072,363 and 2,070,266; Research Disclosure No. 21228, December, 1981, etc. In the present invention, the amount of the diffusible DIR coupler added may preferably be 0.01 to 50 mole % relative to silver, particularly 1 to 5 mole %.

In the silver halide emulsion to be used in the light-sensitive silver halide photographic material of the present invention, there may be employed any of silver halides conventionally used in silver halide emulsions such as silver bromide, silver iodobromide, silver iodochloride, silver chlorobromide and silver chloride, etc.

The silver halide grains to be used in the silver halide emulsion of the present invention may be one obtained by either one of the acidic method, the neutral method or the ammoniacal method. Said grains may be grown at one time or grown after preparation of seed grains. The method for preparation of seed grains and the method for growth may be either the same or different.

The silver halide emulsion may be made either by mixing simultaneously halogen ions and silver ions or by mixing either one of them into the other. Also, while considering the critical growth speed of silver halide crystals, it may be formed by adding halide ions and silver ions successively at the same time while controlling pH and pAg in the mixing vessel. After growth, the halogen composition of the grains may be changed by use of the conversion method.

In preparation of the silver halide emulsion of the present invention, by use of a silver halide solvent if desired, the grains size, the grain shape, the grain size distribution and the grain growth speed of the silver halide grains can be controlled.

The silver halide grains to be used in the silver halide emulsion of the present invention can be added with metal ions by use of cadmium salts, zinc salts, lead salts, thallium salts, iridium salts or complexes, rhodium salts or complexes, iron salts or complexes to include them internally within and/or on the surfaces of the grains, or may be placed in an appropriate reducing atmosphere thereby to impart reducing sensitizing nuclei to the grains internally therein and/or on the surfaces thereof.

In the silver halide emulsion of the present invention, unnecessary soluble salts may be eliminated or contained as such after completion of the growth of the silver halide grains. When said salts are to be removed, it can be practiced on the basis of the method as disclosed in Research Disclosure No. 17643.

The silver halide grains to be used in the silver halide emulsion of the present invention may consist of uniform layers of the inner portion and the surface or alternatively different layers.

The silver halide grains to be used in the silver halide emulsion of the present invention may be grains of the type in which latent images are formed primarily on the surfaces, or of the type in which they are formed primarily within the inner portions of the grains.

The silver halide grains to be used in the silver halide emulsion of the present invention may have regular crystal forms or irregular crystal for such as spheres or plates. In these grains, the proportion of [1,0,0] plane to [1,1,1] plane may be any desired value. Also, these crystal forms may have a complex form, in which grains of various crystal forms may be mixed.

The silver halide emulsion of the present invention may be used by mixing two or more kinds of silver halide emulsions formed separately.

In this invention, it is preferred to use monodispersed silver halide grains.

In this invention, the "monodispersed silver halide grains" mean grains in which a weight of the silver halide grains each having an average diameter $\bar{r}$ and diameters within the range of ±20% of the average diameter $\bar{r}$ occupies 60% or more, preferably 70% or more, particularly preferably 80% or more, of the total weight of the silver halide grains. The above-mentioned average diameter $\bar{r}$ can be defined as a grain diameter $r_i$ (significant figures are digits. Count a number of minimum figures of 5 and over as a unit and cut away the rest) at the time when a product $n_i \times r_i^3$ of a frequency $n_i$ of the grains each having the grain diameter $r_i$ and $r_i^3$ is at a maximum level.

The "grain diameter" referred to herein means a diameter of each grain when the silver halide grain is spherical, and a diameter obtained by converting a projected image of each grain into a circular image having the same area when it is not spherical.

The grain diameter can be determined, for example, by enlarging each grain 10,000-fold to 50,000-fold with the aid of an electron microscope, photographing it, and measuring a diameter of the grain or an area of its projected image on the resultant print. (The grains to be measured are selected at random as many as 1,000 or more.)

A layer containing monodispersed silver halide emulsion according to the present invention may contain other monodispersed or polydispersed emulsion than the above. For example, it means that the grains a grain diameter distribution curve of which has a plurality of modes can be included in this invention. The "substantially monodispersed" means that inclusive of such grains as mentioned above, a weight of the silver halide grains having the diameter of the above defined $\bar{r}$ and the diameters within the range of ±20% of the diameter $\bar{r}$ occupies 50% or more, preferably 60% or more, particularly preferably 70% or more, of the total weight of the grains.

The monodispersed silver halide grains of the present invention and the first coupler and the second coupler are desirebly contained in at least one emulsion layers of the light-sensitive photographic material having at least one silver halide emulsion layers.

The silver halide grains to be used in the present invention may be so-called twinned crystal which has irregular shape such as plate-like shaped, etc. and also may be regulated shape such as cubic, octahedral or tetradecahedral sperical shaped, but preferably octahedral or tetradecahedral. Said silver halide grains may be so-called core-shell type which has different photographic performances or silver halide compositions between a core portion and a shell portion.

The silver halide emulsion of the present invention can be chemically sensitized in a conventional manner. That is, it is possible to use the sulfur sensitization method employing a sulfur compound capable of reacting with silver ions or active gelatin, the selenium sensitization method employing a selenium compound, the reducing sensitization method employing a reducible substance and the noble metal sensitization employing gold or other noble metal compounds, either singly or in combination.

The silver halide emulsion of the present invention can be sensitized optically to a desired wavelength region by use of dyes known as sensitizing dyes in the field of photography. The sensitizing dye may be used either singly or in combination of two or more compounds. It is also possible to incorporate in the emulsion a potentiating sensitizer which is a dye having itself no spectral sensitizing action or a compound which does not substantially absorp visible light, but can strengthen the sensitizing action of a sensitizing dye.

In the silver halide emulsion of the present invention, compounds known as antifoggants or stabilizers in the field of photography may be added in the steps for preparation of light-sensitive materials, during storage or during chemical aging for the purpose of preventing fogging during photographic processings and/or maintaining photographic performances stably, and/or on and/or after completion of chemical aging or before coating of the silver halide emulsion.

As the binder (or protective colloid) for the silver halide emulsion of the present invention, gelatin may be advantageously used. Otherwise, hydrophilic colloids such as gelatin derivatives, graft polymers of gelatin and other polymer, proteins, cellulose derivatives, synthetic hydrophilic polymeric materials such as homo-or copolymers can also be used.

The photographic emulsion layer or other hydrophilic colloid layers in the light-sensitive material employing the silver halide emulsion of the present invention is hardened by crosslinking the binder (or protective colloid) molecules and using singly or in combination with film hardening agents for enhancing film strength. The film hardening agent should desirably be added in an amount capable of hardening the light-sensitive material to the extent of requiring no addition of a film hardening agent into processing solutions, but it is also possible to add a film hardening agent in a processing solution.

For the purpose of enhancing flexibility of the silver halide emulsion layer and/or other hydrophilic layers in the light-sensitive material employing the silver halide emulsion of the present invention, a plasticizer may be added.

For the purpose of improving dimensional stability of the photographic emulsion layer or other hydrophilic colloid layers in the light-sensitive material employing the silver halide emulsion of the present invention, a dispersion of a water-insoluble or sparingly soluble synthetic polymer (latex) may be contained therein.

In the emulsion layer of the light-sensitive silver halide color photographic material of the present invention, in the color forming development processing, there is employed a dye forming coupler capable of forming a dye through the coupling reaction with the oxidized product of an aromatic primary amine developer (e.g. p-phenylenediamine derivative, aminophenol derivative, etc.). Said dye forming coupler is commonly selected so that a dye capable of absorbing the light-sensitive spectral light in the emulsion layer may be formed for each emulsion layer, and a yellow dye forming coupler is used in the blue-sensitive emulsion layer, a magenta dye forming coupler in the green-sensitive emulsion layer and a cyan dye forming coupler in the red-sensitive emulsion layer. However, depending on the purpose, a light-sensitive silver halide color photographic material may be prepared in a manner different from the above combination.

For prevention of color turbidity through migration of the oxidized product of the developing agent or the electron transfer agent between the emulsion layers in the light-sensitive color photographic material of the present invention (between the layers of the same color sensitive layers and/or different color sensitive layers), deterioration of sharpness and markedness of graininess, a color antifoggant may be used.

Said color antifoggant may be used in the emulsion layer itself, or in an intermediate layer provided between adjacent emulsion layers.

In the color light-sensitive material employing the silver halide emulsion of the present invention, an image stabilizer for preventing deterioration of dye image can be used.

It is also possible to incorporate a UV-absorber for prevention of fogging and deterioration of images by UV-ray due to discharging caused by charging of the hydrophilic colloid layers such as protective layer, intermediate layer, etc. in the light-sensitive material of the present invention.

In the color light-sensitive material employing the silver halide emulsion of the present invention, there may also be provided auxiliary layers such as filter layer, halation preventive layer and/or irradiation preventive layer, etc. In these layers and/or emulsion layers, dyes which are flowed out from the color light-sensitive material or bleached during development processing may be contained.

For the purpose of enhancing writability to reduce the luster of the light-sensitive material or prevention of sticking between the light-sensitive materials, a matting agent may be added in the silver halide emulsion layers and/or other hydrophilic colloid layers used in the light-sensitive silver halide material employing the silver halide emulsion of the present invention.

A lubricant may also be added for the purpose of reducing the slide friction of the light-sensitive material employing the silver halide emulsion of the present invention.

In the light-sensitive material employing the silver halide emulsion of the present invention, there may be added an antistatic agent for prevention of charging. The antistatic agent may be used in the charge prevention layer on the side of the support where no emulsion is laminated or alternatively in the emulsion layer and/or the protective colloid layer other than emulsion layers on the side where emulsion layers are laminated relative to the support.

In the photographic emulsion layer and/or other hydrophilic coloid layers in the light-sensitive material employing the silver halide emulsion of the present invention, various surfactants may be used for the purpose of improvement of coating characteristic, prevention of charging, improvement of slidability, emulsification, prevention of adhesion and improvement of photographic characteristics (promotion of development, hardening of tone, sensitization, etc.).

In the light-sensitive material employing the silver halide emulsion of the present invention, the photographic emulsion layer or other layers may be coated onto a flexible reflective support such as a paper having baryta layer or $\alpha$-olefin polymer laminated thereon, or a synthetic paper, etc. a film comprising a semi-synthetic or synthetic polymer such as cellulose acetate, cellulose nitrate, polystyrene, polyvinyl chloride, polyethylene terephthalate, polycarbonate, polyamide, etc. or a rigid material such as glass, metal, earthenware, etc.

The silver halide material of the present invention may be applied directly on the support surface, after application of corona discharging, UV-ray irradiation or flame treatment, etc., if desired, or through an intermediary one or more subbing layer (for improvement of adhesiveness, charging prevention, dimensional stability, abrasion resistance, hardness, halation prevention, frictional characteristic and/or other characteristics).

The light-sensitive material of the present invention can be exposed by use of an electromagnetic wave in the spectral region to which the emulsion layer constituting the light-sensitive material of the present invention has sensitivity. As the light source, there may be employed any of the known light sources such as natural light (sunlight), tungsten lamp, fluorescent lamp, mercury lamp, xenon arc lamp, carbon arc lamp, xenon flash lamp, cathode ray tube flying spot, various laser beams, emission diode light, electron beam, X-ray, light emitted from a fluorescent material excited by $\gamma$-ray, $\alpha$-ray, etc.

The exposure time may be an exposure time from 1 millisecond to one second conventionally used in cameras, as a matter of course, or even shorter than 1 millisecond, for example, exposure for 100 microseconds to 1 microsecond. Also, exposure for longer than one seconds is possible. Said exposure may be effected either continuously or intermittently.

The light-sensitive silver halide photographic material of the present invention is capable of forming an image by carrying out color development known in this field of the art.

The aromatic primary amine color developing agent to be used in the color developing solution in the present invention includes known compounds used widely in various color photographic processes. These developing agents may include aminophenol type and p-phenylenediamine type derivatives. These compounds are generally employed in the form of salts such as hydrochlorides or sulfates which are more stable than in free state. These compounds are generally employed at concentrations of about 0.1 g to about 30 g, preferably about 1 g to about 1.5 g, per one liter of the color developing solution.

An aminophenol type developing solution may contain, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amine type color developing agents are N,N'-dialkyl-p-phenylenediamine type compounds, and the alkyl group and the phenyl group may be substituted with any desired substituent. Among them, examples of particularly useful compounds may include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-γ-methanesulfonamidoethyl-3-methyl-4-aminoaniline sulfate, N-ethyl-N-γ-hydroxyethylaminoaniline, 4-amino-3-methyl-N,N'-diethylaniline, 4-amino-N-(2-methoxyethyl)-N-ethyl-3-methylaniline-p-toluenesulfonate, etc.

In the color developing solution to be used in the processing of the present invention, there may further be contained, in addition to the above primary aromatic amine type color developing agent, various components generally added in color developing solutions, including alkali agents such as sodium hydroxide, sodium carbonate, potassium carbonate, etc., alkali metal sulfites, alkali metal bisulfites, alkali metal thiocyanates, alkali metal halides, benzyl alcohol, water softening agents, thickeners, etc., as desired. The pH value of the color developing solution may be usually 7 or higher, most generally about 10 to about 13.

In the present invention, after color developing processing, processing with a processing solution having fixing ability is carried out. When the processing solution having said fixing ability is a fixing solution, bleaching processing is carried out before the fixing processing. As the bleaching agent to be used in said bleaching step, there may be employed a metal complex of an organic acid, and said metal complex has the action of oxidizing the silver halide formed by development to silver halide simultaneously with color formation of the unformed portion of the color forming agent, with its constitution comprising an organic acid such as an aminopolycarboxylic acid or oxalic acid, citric acid, etc. coordinated with metal ions such as iron, cobalt, copper, etc. The most preferable organic acid to be used for formation of such a metal complex of an organic acid may include polycarboxylic acids or aminopolycarboxylic acids. These polycarboxylic acids or aminopolycarboxylic acids may be alkali metal salts, ammonium salts or water-soluble amine salts.

Typical examples of these may include the following compounds:

[1] ethylenediaminetetraacetic acid,
[2] nitrilotriacetic acid,
[3] iminodiacetic acid,
[4] disodium ethylenediamintetraacetate,
[5] tetra(trimethylammonium) ethylenediaminetetraacetate,
[6] tetrasodium ethylenediaminetetraacetate, and
[7] sodium nitrilotriacetate.

The bleaching solution to be used contains a metal complex of an organic acid as described above as the bleaching agent, and can also contain various additives. As the additives, it is desirable to contain particularly alkali halides or ammonium halides, for example, rehalogenating agents such as potassium bromide, sodium bromide, sodium chloride, ammonium bromide, etc., metal salts, chelating agents. It is also possible to add conveniently those conventionally known to be added, including pH buffers such as borates, oxalates, acetates, carbonates, phosphates, etc., alkylamines, polyethylene oxides, etc.

Further, the fixing solution and the bleach-fixing solution can also contain pH buffers comprising various salts, for example, sulfites such as ammonium sulfite, potassium sulfite, ammonium bisulfite, potassium bisulfite, sodium bisulfite, ammonium metabisulfite, potassium metabisulfite, sodium metabisulfite, etc., boric acid, borax, sodium hydroxide, potassium hydroxide, sodium carbonate, potassium carbonate, sodium bicarbonate, potassium bicarbonate, acetic acid, sodium acetate, ammonium hydroxide, etc., either singly or as a mixture of two or more compounds.

The present invention is described in more detail by referring to the following Examples, by which the present invention is not limited at all.

EXAMPLE 1

For evaluation the effectiveness of the present invention, coupler emulsifiers of various types were first prepared. The second coupler was dissolved in an 1 N aqueous caustic potash solution, then added to an aqueous 10% gelatin solution and adjusted to pH 7.0 with a 1 N aqueous citric acid solution. The first coupler was dissolved in a solvent mixture of tricresyl phosphate and ethyl acetate, then mixed with an aqueous 10% gelatin solution containing Alkanol XC (produced by Du Pont Co.) as the surfactant, followed by emulsification in a colloid mill. Although the second coupler dispersion may be added into the mixture of the first coupler and emulsified in a colloid mill, no surfactant may be added at this time.

The coupler emulsion as prepared above was added to a silver halide gelatin emulsion, and then a light-sensitive sample [I] comprising respective layers with compositions as shown below provided by coating on a triacetate cellulose film support having a subbing layer provided thereon was prepared.

1. Emulsion layer

Negative type green-sensitized silver iodobromide (1 mole %, 7.0)

Amount of silver coated: 1.6 g/m$^2$

First coupler: m - 5 . . . 0.018 mole per mole of silver

Second coupler: M - 3 . . . 0.001 mole per mole of silver

Diffusible DIR coupler: DC - 2 . . . 0.001 mole per mole of silver

Gelatin: 1.6 g/m$^2$

Tricresyl phosphate: 0.5 g/m$^2$

2. Protective layer

Gelatin: 1.3 g/m$^2$ 2,4-dichloro-6-hydroxy-S-triazine sodium salt: 0.05 g/m$^2$ For comparison, a light-sensitive sample [II] using the first coupler alone was prepared. That is, the couplers in the above emulsion layer were changed to the following compounds:

First coupler: m - 5 . . . 0.02 mole per mole of silver

Diffusible DIR coupler: DC - 2 . . . 0.001 mole per mole of silver.

The method for dispersing DIR coupler was the same as the method for dispersing the first coupler m - 5.

The light-sensitive samples as prepared above were subjected to wedge exposure at 1.6 CMS, and then subjected to the following processings with processing solutions as previously described (processing temperature: 38° C.):

| | |
|---|---|
| (1) Color developing | 3 min. 15 sec. |
| (2) Bleaching | 6 min. 30 sec. |
| (3) Water washing | 3 min. 15 sec. |
| (4) Fixing | 6 min. 30 sec. |
| (5) Water washing | 3 min. 15 sec. |
| (6) Stabilizing | 3 min. 15 sec. |

The density of the processed sample was measured with the use of green light. The results are shown in Table 1.

TABLE 1

| Sample | Coupler | DIR coupler | Fog | Sensitivity | R.M.S. at D = 0.70 | MTF value at space frequency of 5 cycle/mm |
|---|---|---|---|---|---|---|
| (I) (Invention) | m-5 + M-3 | DC-2 | 0.07 | 109 | 35.5 | 1.22 |
| (II) (Control) | m-5 | DC-2 | 0.07 | 100 | 42.0 | 1.12 |

The relative sensitivity is the reciprocal of the dose which gives a color formed density of fog ±0.2 and calculated with the value of Sample (II) as 100. As is apparent from Table 1, it can be understood that the sharpness represented by MTF value is improved by combination of the combined couplers with the diffusible DIR coupler according to the present invention. When M - 11, M - 6, M - 12 or M - 16 was employed in place of M -3, similar effects could be obtained.

EXAMPLE 2

On a cellulose triacetate base, a multi-layer light-sensitive sensitive sample [III] comprising respective layers with compositions shown below was prepared:

1. First layer: gelatin layer containing black colloidal silver,
2. Second layer: gelatin layer containing an emulsified dispersion of 2,5-di-(t)octylhydroquinone,
3. Third layer: low sensitivity red-sensitive emulsion layer
   Silver iodobromide (red-sensitized with light-sensitive dye) (silver iodide 5 mole %) . . . Amount of silver coated: 1.85 g/m$^2$
   First coupler: C - 4 . . . 0.04 mole per mole of silver
   Second coupler: C - 1 . . . 0.002 mole per mole of silver
   1-Hydroxy-4-(2-carboethoxyphenylazo)-N-[α-(2,4-di-t-amylphenoxy)butyl]-2-napthoamide (cc - 1) . . . 0.004 mole per mole of silver
   Diffusible DIR coupler: DC - 1 . . . 0.003 mole per mole of silver
   Gelatin: 2.0 g/m$^2$ (Compounds other than the second coupler C - 1 were emulsified with tricresyl phosphate. The second coupler C - 1 was subjected to alkali dispersion. The respective layers shown below were also added in the same manner.)

4. Fourth layer: high sensitivity red-sensitive emulsion layer
   Silver iodobromide (red-sensitized with light-sensitive dye) (silver iodide 8 mole %) . . . Amount of silver coated: 2.01 g/m$^2$
   First coupler: c - 4 . . . 0.02 mole per mole of silver
   Gelatin: 1.8 g/m$^2$
5. Fifth layer: intermediate layer the same as the second layer
6. Sixth layer: low sensitivity green-sensitive emulsion layer
   Silver iodobromide (green-sensitized with light-sensitive dye) (silver iodide 4 mole %) . . . Amount of silver coated: 1.6 g/m$^2$
   First coupler: m - 5 . . . 0.05 mole per mole of silver
   Second coupler: M - 1 . . . 0.0015 mole per mole of silver
   1-(2,4,6-trichlorophenyl)-3-[3-(α-(2,4-di-t-amylphenoxy)acetamido}benzamido]- 4-(4-methoxyphenylazo)-5-pyrazolone (CM - 1) . . . 0.01 mole per mole of silver
   Diffusible DIR coupler: DC - 1 . . . 0.003 mole per mole of silver
   Gelatin: 1.2 g/m$^2$
7. Seventh layer: high sensitivity green-sensitive emulsion layer
   Silver iodobromide (green-sensitized with light-sensitive dye) (silver iodide 7 mole %) . . . Amount of silver coated: 1.8 g/m$^2$
   First coupler: m - 5 . . . 0.01 mole per mole of silver
   Gelatin: 1.7 g/m$^2$
8. Eighth layer: Yellow filter layer
   gelatin layer containing an emulsified dispersion of yellow colloidal silver and 2,5-di-t-octylhydroquinone
9. Ninth layer: low sensitivity blue-sensitive emulsion layer
   Silver iodobromide (silver iodide 6 mole %) . . . Amount of silver coated: 1.6 g/m$^2$
   First coupler: y - 2 . . . 0.25 mole per mole of silver
   Second coupler: Y - 2 . . . 0.015 mole per mole of silver
   Gelatin: 2.5 g/m$^2$
10. Tenth layer: high sensitivity blue-sensitive emulsion layer
   Silver iodobromide (silver iodide 8 mole %) . . . Amount of silver coated: 1.1 g/m$^2$ First coupler: y - 2 . . . 0.06 mole per mole of silver
Gelatin: 1.4 g/m$^2$ 11. Eleventh layer: Gelatin protective layer As sample [IV] for comparison, in the above constitution, the second couplers C - 1, M - 1 and Y - 2 in the third layer, the sixth layer and the ninth layer were omitted, respectively, and instead thereof the amounts of the first couplers c - 4, m - 5 and y - 2 were increased in moles corresponding to the second couplers for sample [IV], respectively.

On the other hand, samples [V] to [X] were prepared with the same compositions except for changing the DIR couplers as shown in Table 2 for the combinations of the couplers and DIR couplers of samples [III] and [IV], respectively.

The light-sensitive materials thus obtained were subjected to wedge exposure with white light and then developed in the same manner as in Example 1.

For cyan images and magenta images of these samples, MTF values at frequency of 7 cycles/mm were measured.

On the other hand, for determining the overlaying effect from the red-sensitive emulsion layer to the green-sensitive emulsion layer, first uniform exposure was given with green light, subsequently wedge exposure was effected with red light, followed by the same developing processing as in Example 1, and the maximum and minimum magenta densities of negative were measured and the density difference between them was calculated.

These results are summarized in Table 2.

TABLE 2

| Sample | Coupler of 3rd layer | Coupler of 6th layer | Coupler of 9th layer | DIR Coupler | MTF value of cyan image 7 cycles/mm | MTF value of magenta image 7 cycles/mm | Difference between maximum and minimum densities (magenta image) |
|---|---|---|---|---|---|---|---|
| III (This invention) | c-4 + C-1 | m-5 + M-1 | y-2 + Y-2 | DC-1 | 1.28 | 1.27 | 0.35 |
| IV (Comparative) | c-4 | m-5 | y-2 | DC-1 | 1.10 | 1.11 | 0.58 |
| V (This invention) | c-4 + C-1 | m-5 + M-1 | y-2 + Y-2 | DC-4 | 1.29 | 1.26 | 0.35 |
| VI (This invention) | c-4 + C-1 | m-5 + M-1 | y-2 + Y-2 | DC-33 | 1.26 | 1.24 | 0.34 |
| VII (This invention) | c-4 + C-1 | m-5 + M-1 | y-2 + Y-2 | DC-34 | 1.18 | 1.19 | 0.30 |
| VIII (This invention) | c-4 + C-1 | m-5 + M-1 | y-2 + Y-2 | DC-48 | 1.19 | 1.20 | 0.30 |
| IX (This invention) | c-4 + C-1 | m-5 + M-1 | y-2 + Y-2 | DC-51 | 1.21 | 1.22 | 0.31 |
| X (This invention) | c-4 + C-1 | m-5 + M-1 | y-2 + Y-2 | DC-58 | 1.25 | 1.24 | 0.33 |

As is apparent from Table 2, it can be appreciated that MTF values of cyan images and magenta images are enhanced to improve sharpness by combination of the couplers and the combination with the diffusible couplers DIR coupler according to the present invention.

On the other hand, as to the inter image effect represented by the difference between the maximum and minimum magenta densities, it becomes extremely high in the sample [IV] and not desirable in color reproduction.

EXAMPLE 3

Preparation of Polydispersed Emulsion

An ammoniacal silver nitrate solution and an aqueous alkali-halide solution were placed, by gravity-drop, in a reaction vessel a temperature of which was maintained at 60° C. and in which an aqueous gelatin solution and an exessive halide had previously been put, and precipitation and desalting were then carried out by adding an aqueous Demol N (trade name, made by Kao Atlas Co., Ltd.) solution and an aqueous magnesium sulfate solution. Subsequently, gelatin was added thereto in order to prepare an emulsion having pAg 7.8 and pH 6.0. A chemical ripening was then carried out using sodium thiosulfate, chloroauric acid and ammonium thiocyanate, and 4-hydroxy-6-methyl-1,3,3a,7-tetrazaindene and 6-nitrobenzimidazole were then added thereto. Further, gelatin was added thereto, whereby polydispersed silver iodobromide emulsion was prepared. In this case, a mole % value of silver iodide was varied by changing a composition of the alkali-halide and an average grain diameter and a grain distribution were varied by changing an addition time of the aqueous silver nitrate solution and the aqueous alkali-halide solution.

Preparation of monodispersed emulsion

An aqueous ammoniacal silver nitrate solution and an aqueous potassium bromide solution were added in a reaction vessel in which potassium iodide and an aqueous gelatin solution had previously been put, in proportion to an increase in surface area at a grain growing period, while a pAg of a mixture in the reaction vessel were maintained at a constant value. Next, precipitation and desalting were then carried out by adding an aqueous Demol N (trade name, made by Kao Atlas Co., Ltd.) solution and an aqueous magnesium sulfate solution. Subsequently, gelatin was added thereto in order to prepare an emulsion having pAg 7.8 and pH 6.0. A chemical ripening was then carried out using sodium thiosulfate, chloroauric acid and ammonium thiocyanate, and 4-hydroxy-6-methyl-1,3,3a,7-tetrazaindene and 6-nitrobenzimidazole were then added thereto. Further, gelatin was added thereto, whereby monodispersed silver iodobromide emulsion was prepared. In this case, a mole % value of silver iodide was varied by changing a ratio of potassium iodide to potassium bromide, a grain diameter was varied by changing amounts of the ammoniacal silver nitrate and the potassium halides. A silver iodobromide emulsion used in Example 3, which has wider grain size distribution than the monodispersed emulsion according to this invention and narrower grain size distribution than the above mentioned polydispersed emulsion was prepared by consciously varing the addition rates of the aqueous ammoniacal silver nitrate solution and aqueous potassium bromide solution, and varing the proportion to an increase in surface area at a grain growing period.

A multi-layer light-sensitive sample [XI] was prepared with the same compositions as in Example 2 except for changing the silver halide and the coupler in the layers of 3, 4, 6, 7, 9 and 10 as shown below. In the following, mole % of silver iodide, an amount of gelatin, an amount of coupler and the other additives are the same as in Example 2.

| | | |
|---|---|---|
| Third layer: | | |
| Silver iodobromide (polydispersed emulsion) | | |
| First coupler | c-7 | |
| Second coupler | C-6 | |
| DIR coupler | DC-35 | |
| cc-1 is the same as in Example 2. | | |
| Fourth layer: | | |
| Silver iodobromide (polydispersed emulsion) | | |
| First coupler | c-11 | |
| Second coupler | C-7 | |
| Sixth layer: | | |
| Silver iodobromide (polydispersed emulsion) | | |
| First coupler | m-16 | |
| Second coupler | M-16 | |
| DIR coupler | DC-58 | |
| CM-1 is the same as in Example 2. | | |
| Seventh layer: | | |
| Silver iodobromide (polydispersed emulsion) | | |
| First coupler | m-16 | |
| Second coupler | M-16 | 0.0003 mole per mole of silver |
| Ninth layer: | | |
| Silver iodobromide (polydispersed emulsion) | | |
| First coupler | y-9 | |
| Second coupler | Y-21 | |
| DIR coupler | DC-8 | 0.002 mole per mole of silver |
| Tenth layer: | | |
| Silver iodobromide (polydispersed emulsion) | | |
| First coupler | y-17 | |
| Second coupler | Y-3 | 0.002 mole per mole of silver |

Next, sample [III] which has the same coupler and constitution as the sample [IX] except for changing the silver halide to monodispersed emulsion was prepared. And sample [XIII] for comparison was prepared, in the sample [XI], the second couplers C - 6, C - 7, M - 16, Y - 21 and Y - 3 in the third, fourth, sixth, seventh, ninth and tenth layers were omitted, respectively, and instead thereof the amounts of the first couplers c - 7, c - 11, m - 16, y - 9 and y - 17 were increased in moles corresponding to the second couplers for sample [XIII], respectively.

The light-sensitive materials thus obtained were subjected to wedge exposure with white light and then developed in the same manner as in Example 2, and these results are summerized in Table 3.

TABLE 3

| | RMS ($D_{min}$ + 1.0) | | | MTF (30 lines/mm) | | |
|---|---|---|---|---|---|---|
| Sample | XI | XII | XIII (Comparative) | XI | XII | XIII (Comparative) |
| Yellow image | 55 | 50 | 62 | 0.97 | 1.05 | 0.90 |
| Magenta image | 38 | 33 | 44 | 0.78 | 0.83 | 0.69 |
| Cyan image | 33 | 30 | 39 | 0.49 | 0.59 | 0.44 |

As clearly seen from Table 3, it can be appreciated that images are improved by combination of the present constitution and the monodispersed silver halide emulsion.

By the combination of the couplers and the combination with the diffusible DIR coupler according to the present invention, an adequate inter image effect could be obtained, whereby images preferable in color reproduction excellent in color balance could be obtained.

What is claimed is:

1. A light-sensitive photographic material, comprising a silver halide emulsion layer containing a first coupler having a lipophilic group and being dispersed in high boiling point organic solvent droplets, a second coupler having at least one sulfonic acid group and being dispersed in an alkaline aqueous solution with the amount of the second coupler relative to the total amount of the first and the second coupler relative to the total amount of the first and the second couplers being 30 mole % or less and a compound capable of releasing a diffusible development inhibiting substance or a precursor thereof in an amount effective to improve sharpness of image when the photographic material is image-wise exposed and then developed of 0.003 to 50 mole % relative to silver.

2. A light-sensitive photographic material according to claim 1, wherein said first coupler is a yellow coupler represented by the following formula (II):

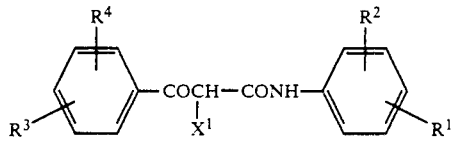

(II)

wherein $R^1$, $R^2$, $R^3$ and $R^4$ are each substituting component of substituent or atom, $X^1$ is a group or an atom eliminable through the reaction of the coupler of the formula (II) and an oxidized product of a color forming developing agent, provided that at least one of $R^1$ to $R^4$ has a lipophilic group.

3. A light-sensitive photographic material according to claim 1, wherein said second coupler is a yellow coupler represented by the following formula (II):

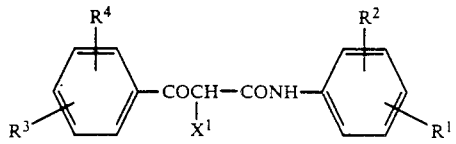

(II)

wherein $R^1$, $R^2$, $R^3$ and $R^4$ are each substituting component of substituent or atom, $X^1$ is a group or an atom eliminable through the reaction of the coupler of the formula (II) and an oxidized product of a color forming developing agent, provided that at least one of $R^1$ to $R^4$ has a diffusion preventive group and at least one of $R^1$ to $R^4$ and $X^1$ contains a sulfonic acidic group.

4. A light-sensitive photographic material according to claim 1, wherein said first coupler is a yellow coupler represented by the following formula (III):

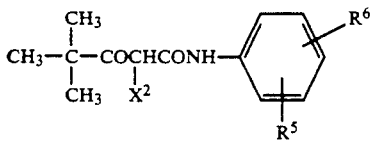

(III)

wherein $R^5$ and $R^6$ are each substituting component of substituent or atom, $X^2$ is a group or an atom eliminable through the reaction of the coupler of the formula (III) and an oxidized product of a color forming developing agent, provided that at least one of $R^5$ and $R^6$ has a lipophilic group.

5. A light-sensitive photographic material according to claim 1, wherein said second coupler is a yellow coupler represented by the following formula (III):

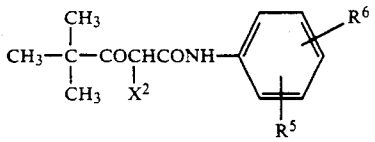

(III)

wherein $R^5$ and $R^6$ are each substituting component of substituent or atom, $X^2$ is a group or an atom eliminable through the reaction of the coupler of the formula (III) and an oxidized product of a color forming developing agent, provided that at least one of $R^5$ and $R^6$ has a diffusion preventive group and at least one of $R^5$, $R^6$ and $X^2$ contains a sulfonic acid group.

6. A light-sensitive photographic material according to claim 1, wherein said first coupler is a magenta coupler represented by the following formula (IV):

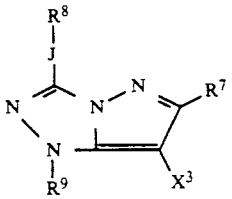

(IV)

wherein $R^7$, —J—$R^8$ and $R^9$ are each substituting component of substituent or atom, J is a bonding of —O—, —S—,

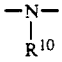

where $R^{10}$ is a hydrogen atom or an alkyl group, $X^3$ is a group or an atom eliminable through the reaction of the coupler of the formula (IV) and an oxidized product of a color forming developing agent, provided that at least one of $R^7$ to $R^9$ has a lipophilic group.

7. A light-sensitive photographic material according to claim 1, wherein said second coupler is a magenta coupler represented by the following formula (IV):

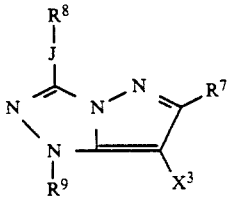

(IV)

wherein $R^7$, —J—$R^8$ and $R^9$ are each substituting component of substituent or atom, J is a bonding of —O—, —S—,

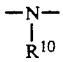

where $R^{10}$ is a hydrogen atom or an alkyl group, $X^3$ is a group or an atom eliminable through the reaction of the coupler of the formula (IV) and an oxidized product of a color forming developing agent, provided that at least one of $R^7$ to $R^9$ has a diffusion preventive group and at least one of $R^7$ to $R^9$ and $X^3$ contains acid group.

8. A light-sensitive photographic material according to claim 1, wherein said first coupler is a magenta coupler represented by the following formula (V) or (VI):

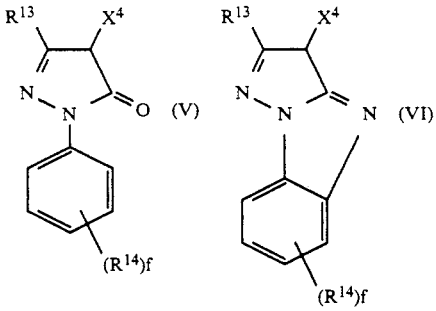

(V) (VI)

wherein $R^{13}$ and $R^{14}$ are each substituting component of substituent or atom, $X^4$ is a group or an atom eliminable through the reaction of the coupler of the formula (V) or (VI) and an oxidized product of a color forming developing agent, provided that at least one of $R^{13}$ and $R^{14}$ has a lipophilic group.

9. A light-sensitive photographic material according to claim 1, wherein said second coupler is a magenta coupler represented by the following formula (V) or (VI):

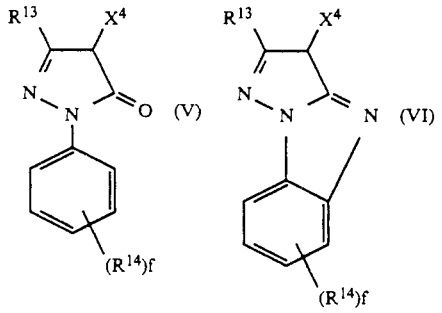

wherein $R^{13}$ and $R^{14}$ are each substituting component of substituent or atom, $X^4$ is a group or an atom eliminable through the reaction of the coupler of the formula (V) or (VI) and an oxidized product of a color forming developing agent, provided that at least one of $R^{13}$ and $R^{14}$ has a diffusion preventive group and at least one of $R^{13}$, $R^{14}$ and $X^4$ contains a sulfonic acid group.

10. A light-sensitive photographic material according to claim 1, wherein said first coupler is a cyan coupler represented by the following formula (VII) or (VIII):

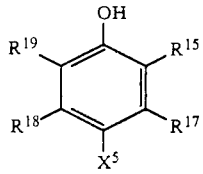

(VII)

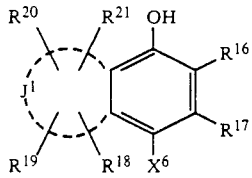

(VIII)

wherein $R^{15}$ to $R^{21}$ are each substituting component of substituent of atom, $X^5$ and $X^6$ are each a group or an atom eliminable through the reaction of the coupler of the formula (VII) or (VIII) and an oxidized product of a color forming devloping agent, provided that at least one of $R^{15}$ to $R^{21}$ has a lipophilic group and $J^1$ represents non-metal atoms necessary for formation of a 5- or 6-membered ring.

11. A light-sensitive photographic material according to claim 1, wherein said second coupler is a cyan coupler represented by the following formula (VII) or (VIII):

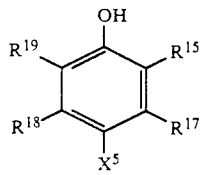

(VII)

-continued

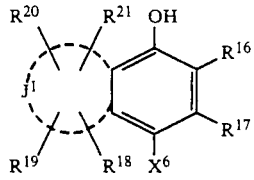

(VIII)

wherein $R^{15}$ to $R^{21}$ are each substituting component of substituent or atom, $X^5$ and $X^6$ are each a group or an atom eliminable through the reaction of the coupler of the formula (VII) or (VIII) and an oxidized product of a color forming developing agent, provided that at least one of $R^{15}$ to $R^{21}$ has a diffusion preventive group and at least one of $R^{15}$ to $R^{21}$, $X^5$ and $X^6$ contains a sulfonic acid group and $J^1$ represents non-metal atoms necessary for formation of a 5- or 6-membered ring.

12. The light-sensitive photographic material of claim 1 wherein the dyes formed by the reaction of the first coupler and the second coupler with an oxidized product of a color developing agent have the same color hue.

13. The light-sensitive photographic material of claim 1, wherein said development inhibiting substance or precursor thereof is present in an amount of 0.01 to 50 mole % relative to the silver content.

14. A light-sensitive photographic material according to claim 1, wherein said compound capable of releasing a diffusible development inhibiting substance or a precursor thereof is a compound having a diffusion degree of 0.4 or higher.

15. A light-sensitive photographic material according to claim 14, wherein said compound is a compound represented by the formula (IX):

$$A-(Y)_m \qquad \text{(IX)}$$

wherein A represents a coupler component, Y is a development inhibitor or a group containing it which is bonded at the coupling position of A, and m is 1 or 2.

16. A light-sensitive photographic material according to claim 15, wherein said Y in the formula (IX) is those represented by the formulae (Xa) to (XIII):

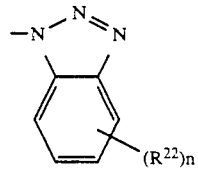

(Xa)

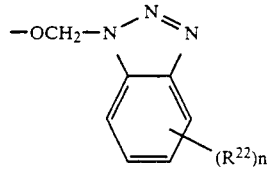

(Xb)

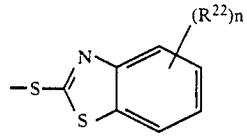

(Xc)

-continued (Xd)

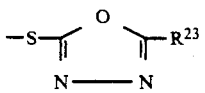

(Xe)

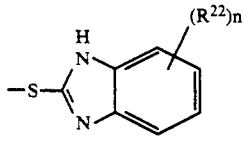

(XI)

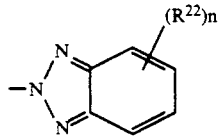

(XII)

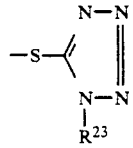

(XIII)

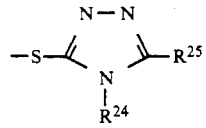

wherein $R^{22}$ represents an alkyl group, an alkoxy group, an acylamino group, a halogen atom, an alkoxycarbonyl group, an aryloxycarbonyl group, a thiazolylideneamino group, an acyloxy group, a carbamoyl group, a nitro group, an amino group, a carbamoyloxy group, a hydroxy group, a sulfamoyl group, an alkoxycarbonylamino group an alkylthio group, an arylthio group, an aryl group, a heterocyclic group, a cyano group, an alkylsulfonyl group or an aryloxycarbonylamino group; n represents 1 or 2; $R^{23}$ represents an alkyl group, an aryl group or a heterocyclic group; $R^{24}$ represents a hydrogen atom, an alkyl group, an aryl group or a heterocyclic group; $R^{25}$ represents a hydrogen atom, an alkyl group, an aryl group, a halogen atom, an amino group, an acylamino group, an alkoxycarbonylamino group, an aryloxycarbonylamino group, an alkanesulfonamide group, a cyano group, a heterocyclic group or an alkylthio group.

17. A light-sensitive photographic material according to claim 15, wherein said Y in the formula (IX) is one represented by the formula (XIV):

—T—DI (XIV)

wherein T is a group bonded to the coupling position of A and is cleavable through the reaction with an oxidized product of a color developing agent, and DI represents a development inhibitor residue.

18. A light-sensitive photographic material according to claim 17, wherein said —T—DI in the formula (XIV) is those represented by the formulae (XV) to (XXI):

(XV)

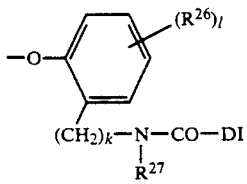

(XVI)

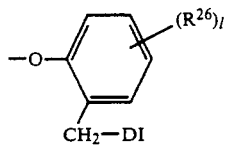

(XVII)

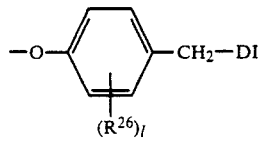

(XVIII)

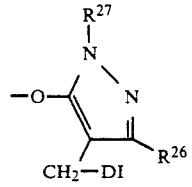

(XIX)

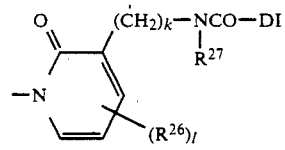

(XX)

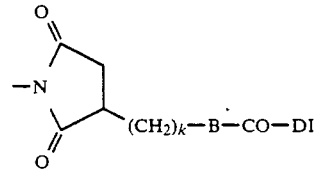

(XXI)

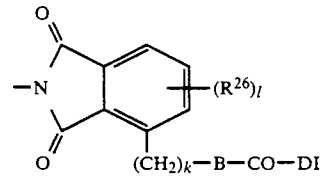

wherein $R^{26}$ represents a hydrogen atom, a halogen atom, an alkyl group, an alkoxy group, an alkenyl group, an alkoxycarbonyl group, an anilino group, an acylamino group, a ureido group, a cyano group, a nitro group, a sulfonamide group, a sulfamoyl group, a carbamoyl group, an aryl group, a carboxy group, a sulfo group, a hydroxy group or an alkylsulfonyl group; $R^{27}$ represents an alkyl group, a cycloalkyl group, an alkenyl group or an aryl group; B represents an oxygen atom or

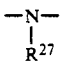

where $R^{27}$ is the same as defined above; DI represents a development inhibitor residue; k is an integer of 0, to 2, and l is an integer of 1 to 2.

19. A light-sensitive photographic material according to claim 15, wherein said A in the formula (IX) is those represented by the formulae (XXII) to (XXX):

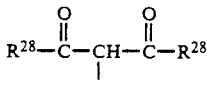

(XXII)

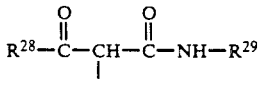

(XXIII)

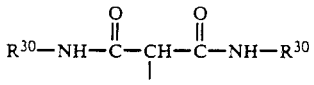

(XXIV)

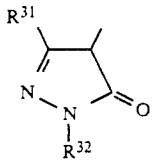

(XXV)

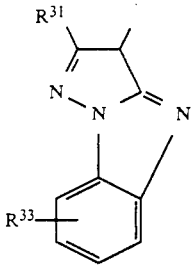

(XXVI)

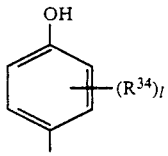

(XXVII)

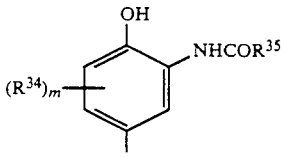

(XXVIII)

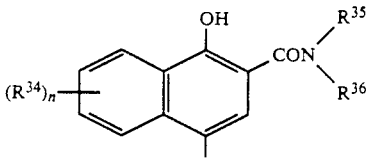

(XXIX)

-continued

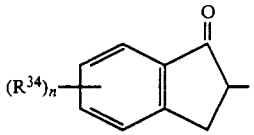

(XXX)

wherein $R^{28}$ represents an aliphatic group, an aromatic group, an alkoxy group or a heterocyclic group; $R^{29}$ $R^{30}$ each represent aromatic groups or heterocyclic groups; $R^{32}$ represents a straight or branched alkyl group having 1 to 40 carbon atoms, an alkenyl group, a cyclic alkyl group, an aralkyl group, a cyclic alkenyl group, an aryl group, a heterocyclic group, an aliphatic or aromatic acyl group, an alkyl sulfonyl group, an arylsulfonyl group, an alkylcarbamoyl group, an arylcarbamoyl group, an alkylthiocarbamoyl group or an arylthiocarbamoyl group; $R^{31}$ represents a hydrogen atom, a straight or branched alkyl group having 1 to 40 carbon atoms, preferably 1 to 22 carbon atoms, an alkenyl group, a cyclic alkyl group, an aralkyl group or a cyclic alkenyl group, an aryl group, a heterocyclic group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alklylacylamino group, an N-arylacylamino group, a ureido group, a urethane group, a thiourethane group, an arylamino group, an alkylamino group, a cycloamino group, a heterocyclic amino group, an alkylcarbonyl group, an arylcarbonyl group, a sulfonamide group, a carbamoyl group, a sulfamoyl group, a cyano group, a hydroxy group, a mercapto group, a halogen atom or a sulfo group; $R^{33}$ represents a hydrogen atom, a straight or branched alkyl group having 1 to 32 carbon atoms, an alkenyl group, a cyclic alkyl group, an aralkyl group, a cyclic alkenyl group, an aryl group, a heterocyclic group, a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamide group, an arylsulfonyl group, an alkylsulfonyl group, an arylthio group, an alkylthio group, an alkylamino group, a dialkylamino group, an anilino group, an N-arylanilino group, an N-alkylanilino group an N-acylanilino group, a hydroxy group or a mercapto group; $R^{34}$ represents a hydrogen atom, halogen atoms, aliphatic hydrocarbon residues, acylamino groups, —O—R—$^{37}$ or —S—$R^{37}$ where $R^{37}$ is an aliphatic hydrocarbon residue; $R^{35}$ and $R^{36}$ each represent groups selected from aliphatic hydrocarbon residues, aryl groups and heterocyclic residues, or alternatively one of them is a hydrogen atom, and these groups are inclusive of those having substituents, or $R^{35}$ and $R^{36}$ are taken together to form a nitrogen-containing heterocyclic ring nucleus; l is an integer of 1 to 4; m is an integer of 1 to 3 and n is an integer of 1 to 5.

* * * * *